US009004144B2

(12) United States Patent
Douglas et al.

(10) Patent No.: US 9,004,144 B2
(45) Date of Patent: Apr. 14, 2015

(54) WINDOW COVERING WITH INDEPENDENTLY MOVABLE SUPPORT RODS

(76) Inventors: Matthew S. Douglas, San Francisco, CA (US); Benjamin L. Douglas, Lafayette, CA (US)

( * ) Notice: Subject to any disclaimer, the term of this patent is extended or adjusted under 35 U.S.C. 154(b) by 0 days.

(21) Appl. No.: 12/562,993

(22) Filed: Sep. 18, 2009

(65) Prior Publication Data

US 2011/0067827 A1 Mar. 24, 2011

(51) Int. Cl.
*E06B 9/40* (2006.01)
*E06B 9/262* (2006.01)

(52) U.S. Cl.
CPC ..... *E06B 9/262* (2013.01); *E06B 2009/2622* (2013.01); *E06B 2009/2627* (2013.01)

(58) Field of Classification Search
CPC ..... B60J 1/2044; E06B 9/581; E06B 9/60
USPC ..... 160/250, 260, 257, 263, 280, 285, 288, 160/327, 338, 266, 241, 242, 243, 84.06, 160/282, 289, 333, 349.1, 167 R; 16/87.4 R, 16/95 R, 93 R, 93 D, 87.2; 248/200.1
See application file for complete search history.

(56) References Cited

U.S. PATENT DOCUMENTS 132,726 A * 11/1872 Landon ..... 160/241
238,925 A * 3/1881 Landon ..... 160/241
362,524 A * 5/1887 Mitter ..... 160/241
510,815 A * 12/1893 Page et al. ..... 160/250
742,989 A * 11/1903 Hoyt ..... 160/288
804,318 A * 11/1905 Hopkins ..... 160/288
928,864 A * 7/1909 Hoyt ..... 160/288
978,379 A * 12/1910 Keeler ..... 160/288
1,007,830 A * 11/1911 Whitmore ..... 160/263
1,233,884 A * 7/1917 Kraemer et al. ..... 160/263
1,309,488 A * 7/1919 Richardson ..... 160/273.1
1,639,551 A * 8/1927 Booth ..... 211/105.6
1,792,846 A * 2/1931 Laraway ..... 160/263
1,985,105 A * 12/1934 Pickett ..... 160/251
1,993,285 A * 3/1935 Sigmund ..... 187/332
2,015,848 A * 10/1935 Hamm ..... 160/288
2,032,842 A * 3/1936 Gould ..... 211/105.6
2,098,016 A * 11/1937 Schuetz ..... 160/288
2,187,242 A * 1/1940 Kesner ..... 160/172 R
2,225,436 A * 12/1940 Lang ..... 160/349.1
2,307,095 A * 1/1943 Zaferakis ..... 160/263
2,564,831 A * 8/1951 Butkus ..... 188/65.1
3,062,381 A * 11/1962 Maiden ..... 211/105.6
3,149,665 A * 9/1964 Handford ..... 160/327

(Continued)

*Primary Examiner* — David Purol
*Assistant Examiner* — Marcus Menezes
(74) *Attorney, Agent, or Firm* — Vierra Magen Marcus LLP

(57) ABSTRACT

A window treatment system and method of installing the system are provided. The system includes a first and a second u-track positioned on opposite sides of a window frame. A first support rod and a second support rod each have a first end positioned in the first u-track and a second end positioned in the second u-track. A shade is coupled to the first and the second support rods and the rods frictionally support the shade and rods within the window frame. The method includes attaching a first u-track to a first side of a window frame and attaching a second u-track to a second, opposing side of a window frame. A shade is installed on the first and second support rods. A first end of a first and second support rod is inserted into the first u-shaped track and a second end of the first and second support rods are inserted in the second u-shaped track.

15 Claims, 22 Drawing Sheets

(56) References Cited

U.S. PATENT DOCUMENTS

| | | | | | |
|---|---|---|---|---|---|
| 3,156,294 | A * | 11/1964 | Miller et al. | 160/173 R |
| 3,162,281 | A * | 12/1964 | Gaulien et al. | 49/374 |
| 3,203,468 | A * | 8/1965 | Gossling et al. | 160/323.1 |
| 4,516,618 | A * | 5/1985 | Gardner et al. | 160/120 |
| 4,574,864 | A * | 3/1986 | Tse | 160/259 |
| 4,649,981 | A * | 3/1987 | Bibeau | 160/120 |
| 4,758,041 | A * | 7/1988 | Labeur | 296/152 |
| 5,117,892 | A * | 6/1992 | Murray | 160/273.1 |
| 5,231,708 | A * | 8/1993 | Hansen | 4/608 |
| 5,676,415 | A * | 10/1997 | Ament et al. | 296/37.16 |
| 5,961,172 | A * | 10/1999 | Ament et al. | 296/37.16 |
| 6,273,175 | B1 * | 8/2001 | Kellogg et al. | 160/205 |
| 6,748,999 | B2 * | 6/2004 | Churchfield | 160/288 |
| 6,763,550 | B2 * | 7/2004 | Regnier | 16/193 |
| 6,942,001 | B1 * | 9/2005 | Crider et al. | 160/241 |
| 7,051,782 | B2 * | 5/2006 | Nichols et al. | 160/310 |
| 7,128,124 | B2 * | 10/2006 | Bibby et al. | 160/263 |
| 7,128,125 | B2 * | 10/2006 | Harbison | 160/273.1 |
| 7,392,834 | B2 * | 7/2008 | Davenport et al. | 160/24 |
| 7,891,400 | B2 * | 2/2011 | Meichtry | 160/210 |
| 2004/0016513 | A1 * | 1/2004 | Hung | 160/84.06 |
| 2004/0159410 | A1 * | 8/2004 | Welfonder | 160/84.06 |
| 2009/0199977 | A1 * | 8/2009 | Bohlen | 160/84.06 |

* cited by examiner

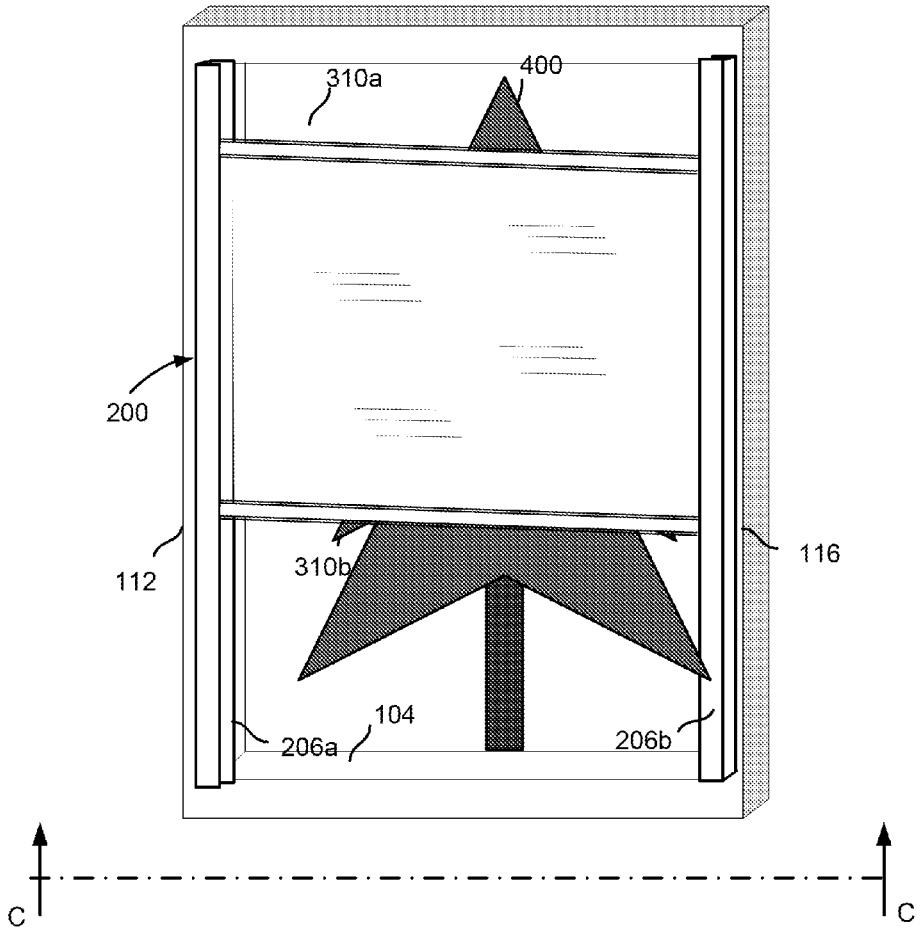
FIG. 19
FIG. 20
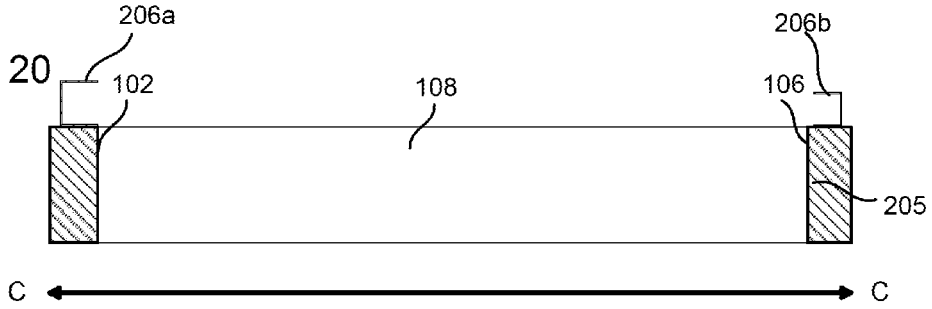

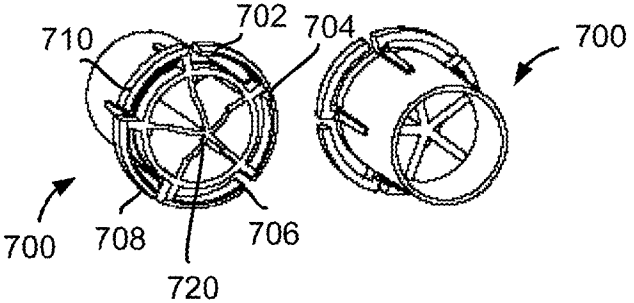
FIG. 21A
FIG. 21B
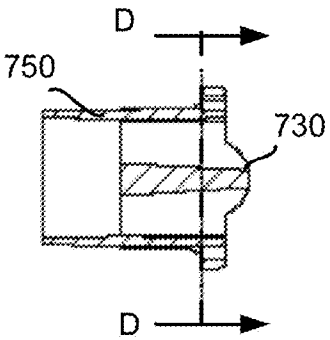
FIG. 21C
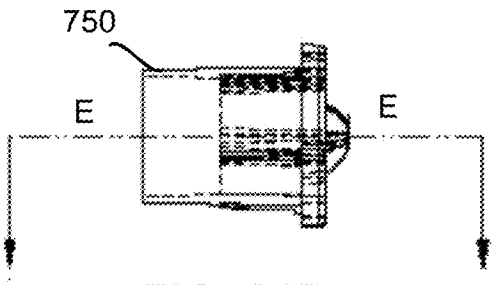
FIG. 21D
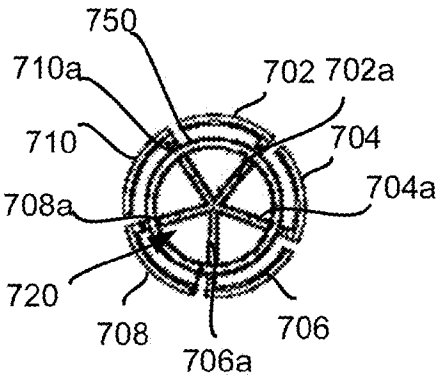
FIG. 21E

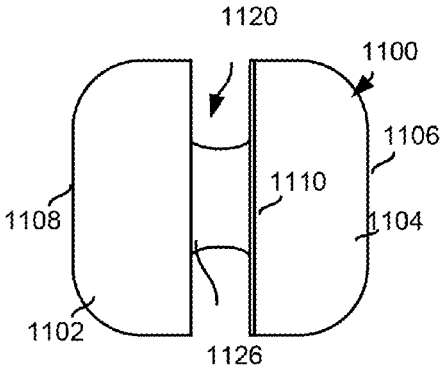
FIG. 26C
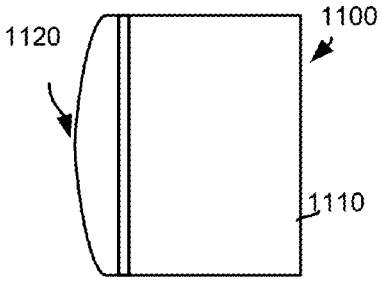
FIG. 26B
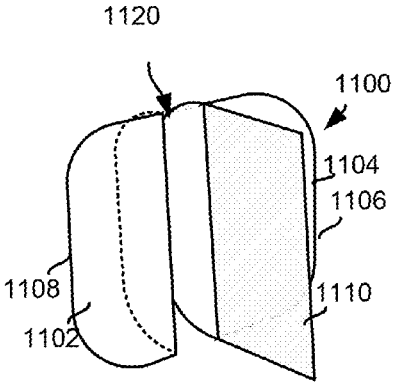
FIG. 26A
FIG. 27
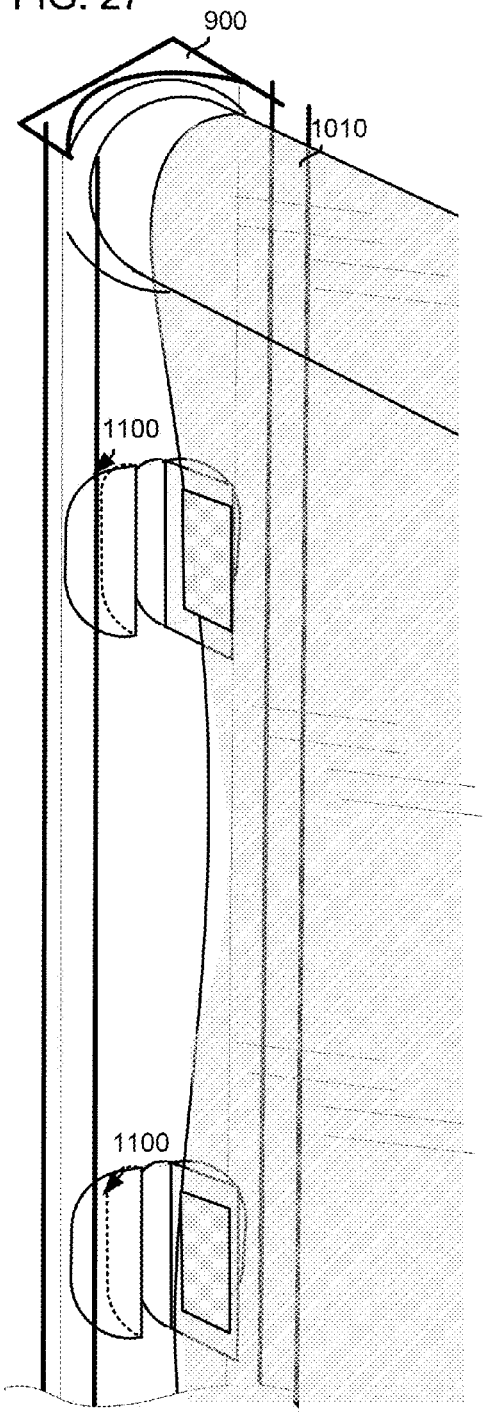

WINDOW COVERING WITH INDEPENDENTLY MOVABLE SUPPORT RODS

BACKGROUND

There are many types of window treatments such as shades, coverings, blinds, shutters, and draperies in use in homes and offices. Window treatments are generally made specifically for the window on which they are intended for use. This means treatments are often costly and require a substantial amount of time to measure, manufacture and install.

Blinds and shades are typically mounted on the interior of a window casing or frame. For this reason, shades, shutters and blinds must be first measured and then created specifically for the particular window application. Often, individuals do not need costly window treatments but would rather have a flexible, less costly window treatment option available to them

SUMMARY

Technology is disclosed to provide a unique window treatment system. The system includes a first and a second u-track positioned on opposite sides of a window frame. A first support rod and a second support rod each have a first end which is positioned in the first u-track and a second end positioned in the second u-track. A shade is coupled to the first and the second support rods and the rods frictionally support the shade and rods within the window frame.

A method of installing a shade assembly is also disclosed. The method includes attaching a first u-track to a first side of a window frame and attaching a second u-track to a second, opposing side of a window frame. A shade is installed on the first and second support rods. A first end of a first support rod is inserted into the first u-shaped track and a second end of the first support rod is inserted in the second u-shaped track. Likewise, a first end of a second support rod is inserted into the first u-shaped track and a second end of the second support rod is inserted into the second u-shaped track.

In another embodiment, a system for supporting a window treatment is provided. The system includes a first track and a second track and at least one support rod having a first end and a second end. A first and a second end caps are positioned on the end of the rod. The end cap includes a housing having a spring-loaded skid plate engaging the track, with the housing and the skid plate creating a friction fit between the cap and the track.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 15C and 16D are front and rear perspective views, respectively, of the third embodiment of the end cap.

FIG. 19 is a perspective view of a window frame having a u-track installed on the exterior of the frame in accordance with the present technology.

FIG. 20 is a cross-section along line C-C in FIG. 19.

FIGS. 21A-21E illustrate a fourth construction of an end cap assembly.

FIG. 26A-26C are perspective, side and front views of a window shade holder.

FIG. 27 is a partial perspective view of the support engaged with a window covering and shade holder.

DETAILED DESCRIPTION

Technology is presented herein which provides a unique dual track window covering which may be utilized in any number of window treatment applications. The window covering can be manufactured of various materials and various types of window shades. Advantageously, the window treatment can be made relatively inexpensively, and can be provided to consumers in a manner which allows the consumer to custom fit the window treatment to a wide variety of window sizes. The nature of the window treatment is such that the upper portion of the treatment or the lower portion of the treatment may be moved manually by a consumer so that the window treatment can cover upper, lower, or the entire portion of a window.

The window treatment disclosed herein uses a dual u-track support structure in combination with one, two or more horizontal support rods. When using one support rod, the rod is used at the upper portion of the covering, window shade or blind. When using two, rods are secured in the u-tracks at the upper and lower portions of a covering, window shade or blind. The covering may be any type of shade including an opaque or transparent fabric, a honeycomb shade, a pleated shade, horizontal mini-blinds or so called "Venetian" blinds, or the like.

Figure 1:
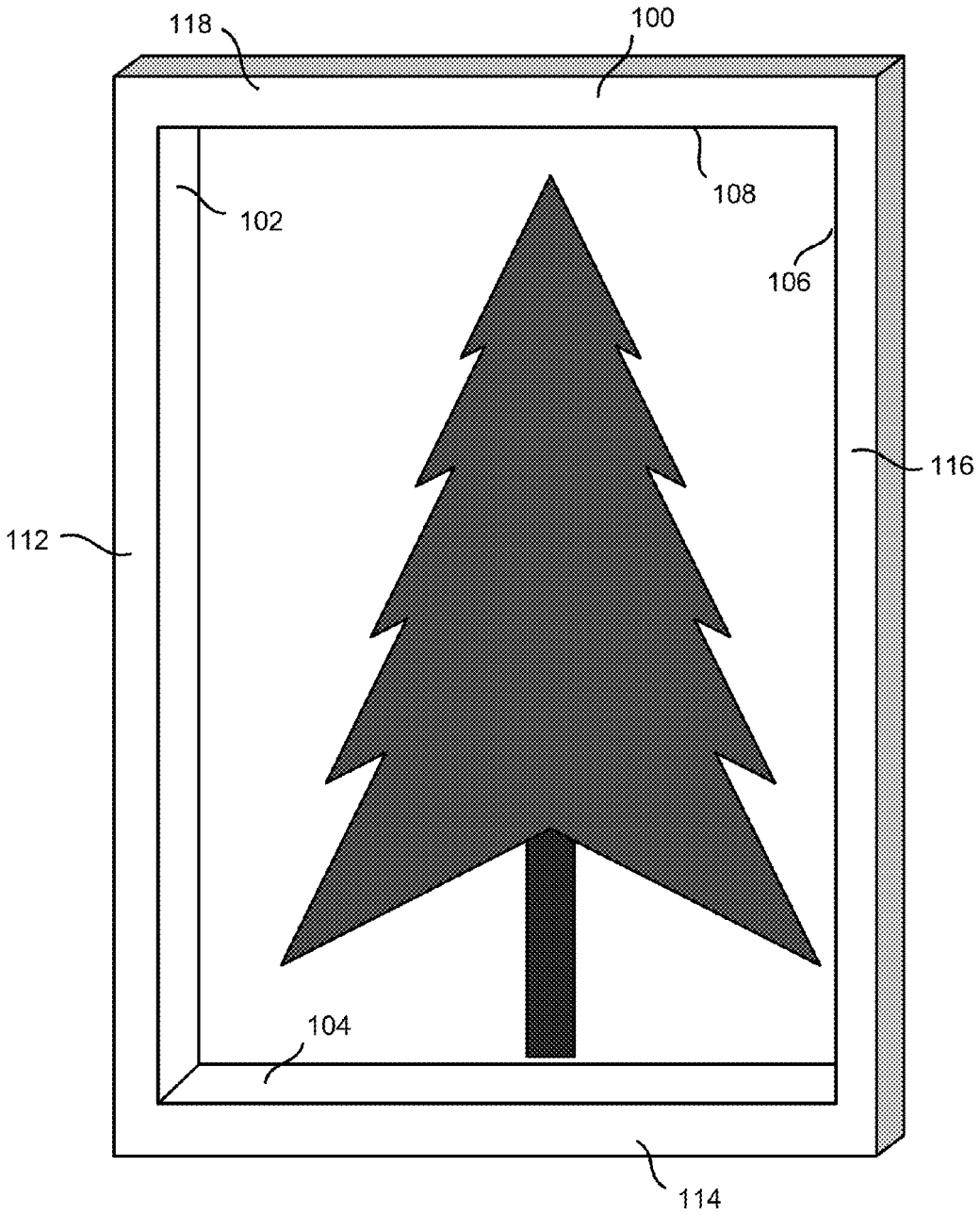
FIG. 1 is a perspective view of a window frame on which the present technology is suitable for use.

FIG. 1 illustrates a window frame 100 including a first side casing 112, a second side casing 116, a top casing 118 and a bottom casing 114. Each casing has an interior edge 102, 104, 106, and 108 which frame the window interior or window glass (not shown). It will be understood that the frame may surround any number of different types of windows, from a single or double sheet of glass, plastic or vinyl, to a single, double hung window or a side-sliding window. The type of window surrounded by the frame is not germane to the technology and the technology may be employed with any window frame where two opposing surfaces such as surfaces 102 and 106 include a generally planer portion extending the length thereof, or at least a portion of the length thereof, so that opposing u-tracks may be mounted opposite to one another. In an alternative embodiment, the u-tracks described herein may be mounted to the front of the frame rather than on interior surfaces, as illustrated in FIGS. 19 and 20.

Figure 2:
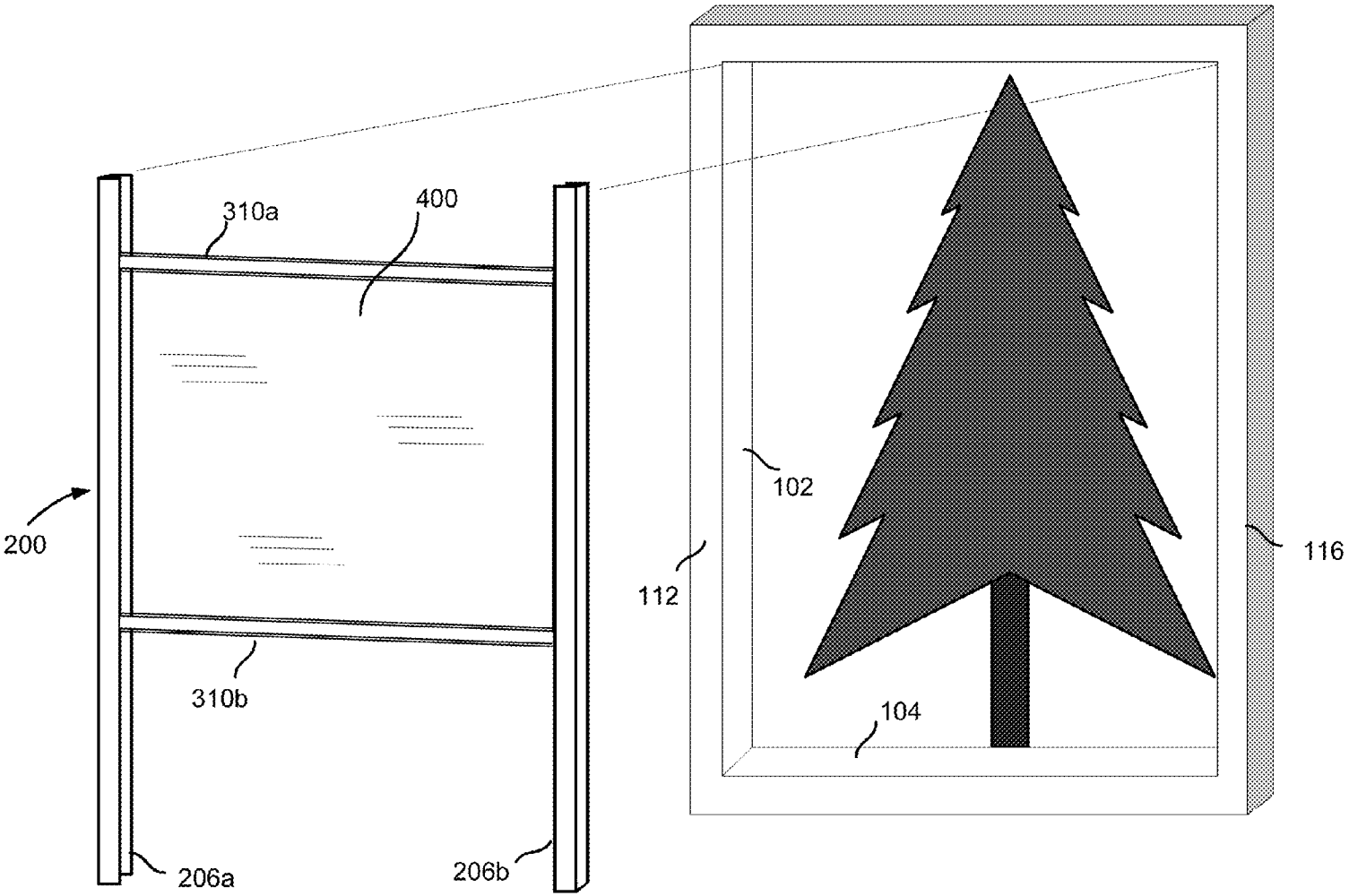
FIG. 2 is a perspective view of a window treatment system in relation to the window frame shown in FIG. 1.
Figure 3:
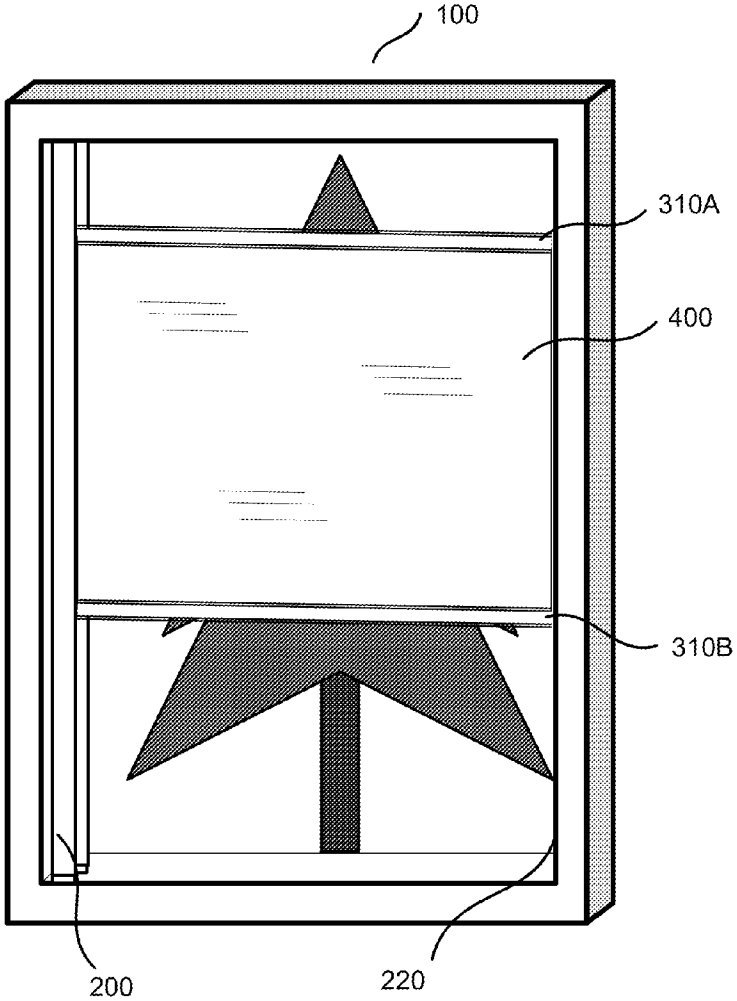
FIG. 3 is a perspective view of an installed window treatment system in the window frame of FIG. 1.

FIGS. 2 and 3 illustrate a first embodiment of the window covering technology. As illustrated in FIGS. 2 and 3, a window covering represented as a shade is utilized. A shade assembly 200 includes a first u-track 206*a*, a second u-track 206*b* (FIG. 5), a first support rod 310*a*, a second support rod 310*b*, and a shade 400. Assembly 200, shown in its assembled form in FIG. 2, is designed to be located within the window frame 100, as illustrated in FIG. 3. It will be understood that the assembly 200 need not be pre-assembled before installation into the frame 100, but may be installed as discussed below.

In accordance with the technology, a u-track 206*a* is mounted on one side of a window frame 100. An opposing u-track 206*b* is mounted in the frame on an opposing surface such that support rods 310 can be extended and inserted between them. In one embodiment, support rods 310 are spring loaded, forcing the ends thereof into engagement within the u-tracks. The u-tracks provide stability for the support rods, allowing the rods to be adjusted to move vertically in the tracks to extend, and retract the window covering 400 based on the position of each of the rods at various locations along the tracks as desired by a user. Each support rod engages the u-track as disclosed herein and through the force of spring and/or tension provided by engagement of the end cap with the U-shaped track in a friction-fit fashion, is maintained in its vertical position with sufficient force to support the window covering. In alternative embodiments, described below, end caps provided on the support rod 310 can provide a snap-fit engagement or a number of different friction or pressure-fit engagements with the U-shaped track. FIG. 3 illustrates a shade assembly 200 within the window frame 100 in a fully assembled fashion. The positioning of the shade in FIG. 3 should be understood to be exemplary. The shade may be fully extended to completely cover the frame, be extended from the top of the frame partially down to the mid-point of the frame, or from the bottom of the frame upward towards the top. That is, the shade 400 may cover any portion of the window between the two support rods 310.

Figure 4:
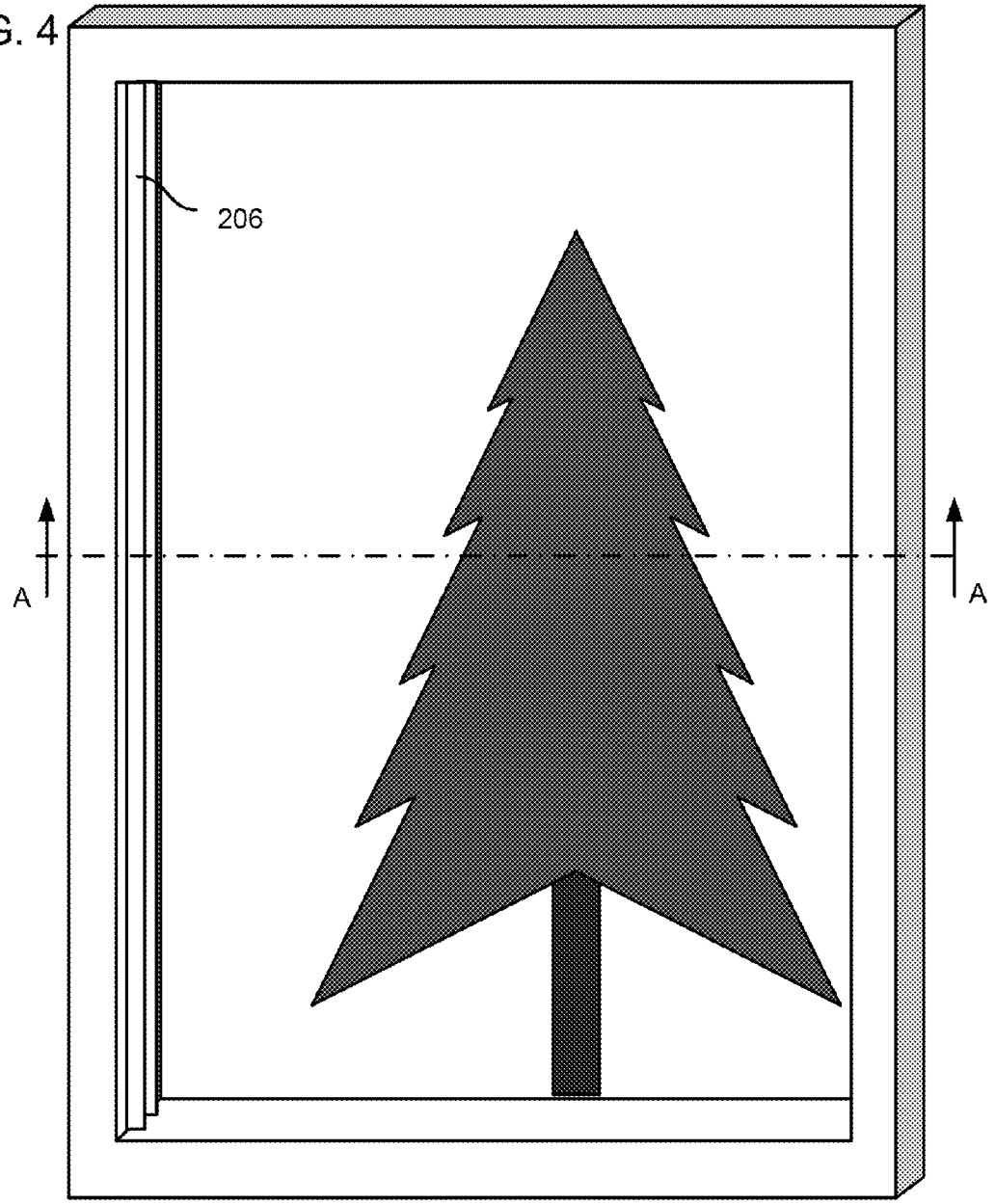
FIG. 4 is a perspective view of a window frame having a u-track installed therein in accordance with the present technology.
Figure 5:
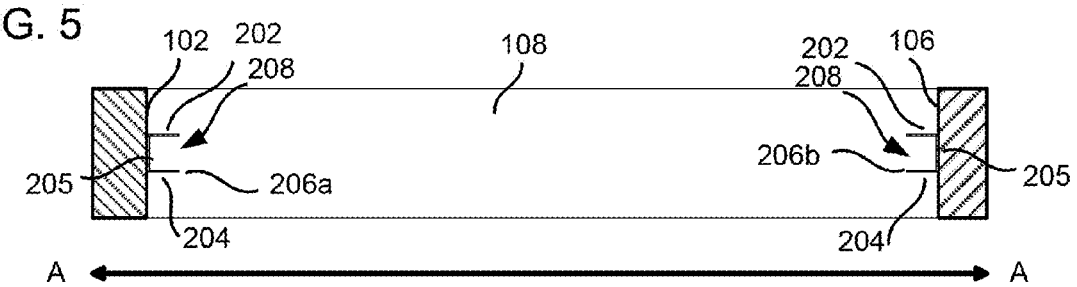
FIG. 5 is a cross-section along line A-A in FIG. 4.

FIGS. 4 and 5 illustrate placement of the u-track within a frame 100. Each u-track 206 is secured within the frame 100 by means of a series of fasteners securing the track 206 to the frame, by gluing, or by other suitable means. In FIGS. 4 and 5, the tracks are illustrated as connected to interior sides 102 and 106. It should be understood by those of average skill in the art that the tracks may alternatively be mounted to sides 104 and 108 so that the window covering may itself be moved horizontally within the window frame. FIG. 5 illustrates two tracks 206*a* and 206*b* in opposing relation. Each track 206 may be fabricated from any number of materials, such as wood, or plastic, vinyl or polyurethane having suitable strength to hold the support rods. The u-tracks may be fabricated at various lengths in an economical manner. Optimally, the u-tracks are manufactured at various lengths and, due to the nature of the material from which the u-tracks are fabricated, the tracks may be easily cut or sawed by an individual using a saw or other cutting tool. This allows the tracks to be assembled by a non-professional installer, and sold without being premeasured and prefabricated for a specific window frame.

Various embodiments of U-tracks and end caps are illustrated herein.

As illustrated in FIG. 5, each u-track includes a base edge 205 which mounts to the window, a first wall 202 and a second wall 204. A channel 208 is defined by each wall. Each wall has a length which is generally equal to the edge of the frame to which it is mounted. As noted above, the shade may be installed in only a portion of the window such that the u-track has a length less than the edge to which it is attached.

As discussed below, the tracks serve an alternative function of providing a cover for the edge of the shade fabric. As discussed below, the shade or honeycomb material edge may rest in the channel 208 of the u-track, providing a clean look for the shade.

Figure 6:
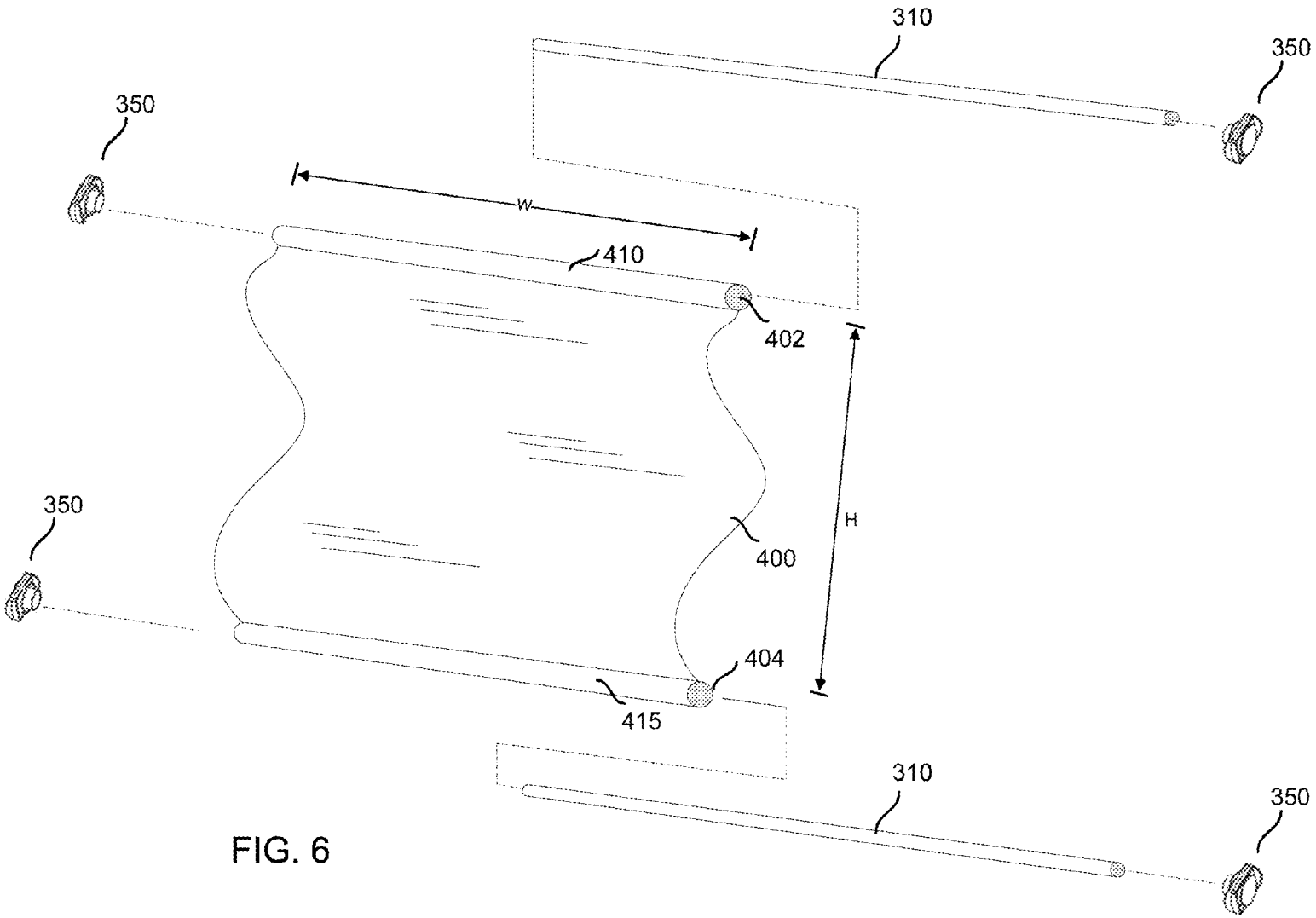
FIG. 6 is an assembly diagram illustrating the manner in which the support rods are inserted into a window shade.

FIG. 6 illustrates one embodiment for the assembly of the support rods 310 into a window shade 400. Various embodiments of support rods are disclosed below. In FIG. 6, shade 400 is illustrated as a cloth shade, but as previously noted may take any number of forms. A first end 402 of the shade 400 may be secured about a tube 410 which has an opening sufficient to allow the support rod 310 to pass there through. Tube 410 may be rigid or may be formed by a closed loop of the fabric of the shade. Likewise, a second end 404 includes a second tube or fabric loop 415 allowing a second support rod 310 to pass there through. The amount of material between ends 402 and 404 defines a maximum height for the shade 400. Likewise, the width of the shade 400 is defined by the material provided. In one embodiment, a user may be provided with a tool allowing the user to cut the shade material to a specific width relative to the support rods. The adjustability of the shade material, combined with the adjustability of support rods which may be cut to variable lengths as described below, allows the shade assembly 400 to be custom fit by the end user to a particular window installation.

Once the u-track 206 is inserted into the window frame 100, the support rods are inserted through the tubes 410 and 415 and have end caps 350 attached thereto. It should be noted that the end caps may be installed prior to insertion of the support rods through tubes 410, 415. End caps may be inserted into respective u-tracks in the frame 100 to secure the shade in position as shown in FIG. 3. In an alternative embodiment, end caps are pre-assembled into the u-tracks prior to providing the tracks to an end user. To complete assembly, one end of each support rod is inserted into one of the u-tracks, for example track 206*a*. Each rod is then compressed and each second end inserted into the second track, for example track 206*b*. The force of the spring or tension member in the rods will then maintain the support rods in the tracks through frictional engagement between the end cap and the u-track. The rods may be held relatively close together so that the edge fabric of the shade material can be allowed to lie in the channel 208 of each respective track.

Each end cap is secured to the support rod through use of a friction fit between the rod and the end cap. Alternatively, a fastener such as a screw (not shown) may be used to secure the end cap to the rod.

Figure 7A:
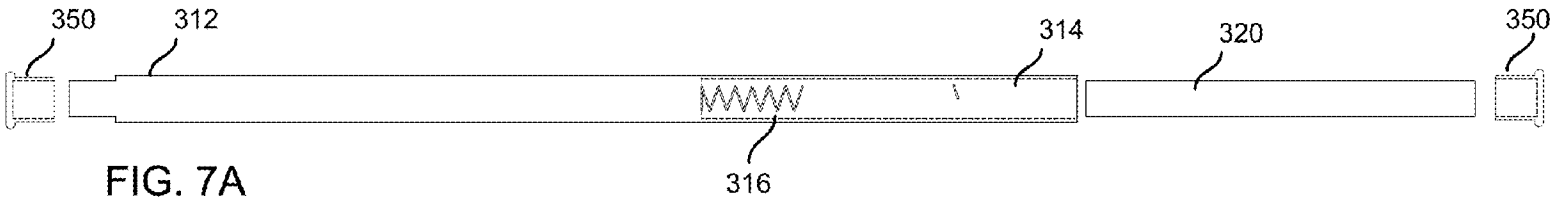
FIG. 7A is an assembly diagram of a first embodiment of a support rod structure in accordance with the present technology.
Figure 7B:
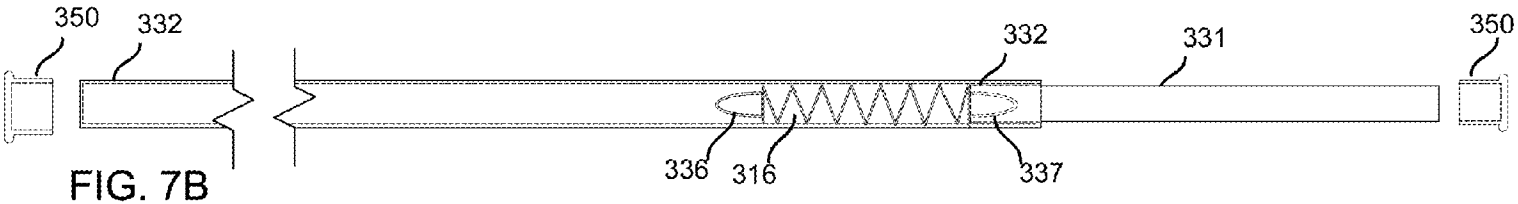
FIG. 7B is an assembly diagram of a second embodiment of a support rod structure in accordance with the present technology.
Figure 8:
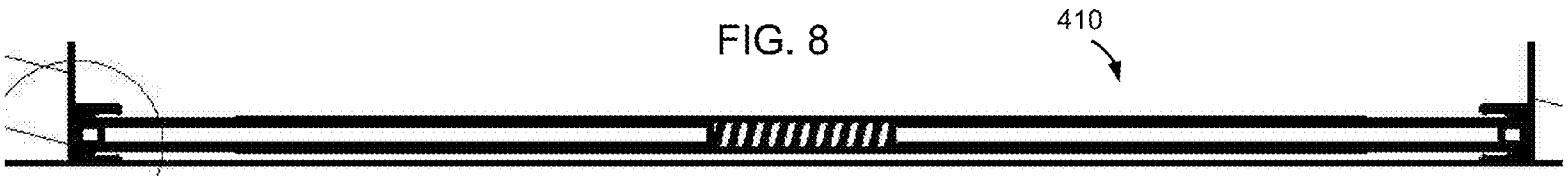
FIG. 8 is an illustration of a third embodiment of a support rod structure in assembled form.
Figure 9:
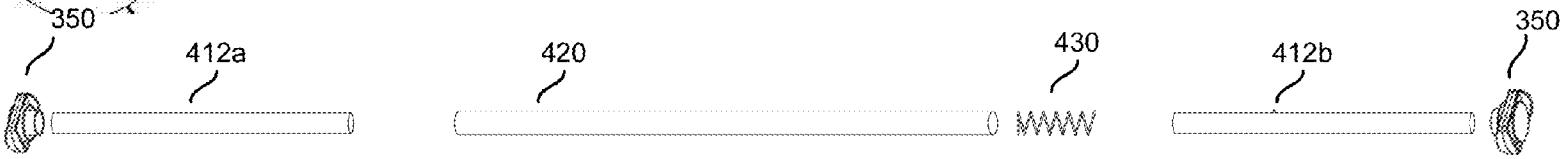
FIG. 9 is an assembly view of the third embodiment of the support rod.

FIGS. 7-9 illustrate two embodiments of a support rod. FIG. 7*a* illustrates a first embodiment of a rod 310, a support rod 310 may be manufactured from a first dowel 312 having a hollow bore 314 in which a spring 316 and second dowel 320 are inserted. End caps 350 may be inserted over each respective end of dowels 312, 320.

FIG. 7B illustrates an all aluminum support rod structure comprised of a hollow rod 334, an end rod 331 and spring 316. Each rod includes a dimple 336, 337, which supports the end of spring 316 within the respect rod. In one embodiment, the end rod may be made to a certain sized length and provided as pre-dimpled at one end and with an end cap 350 on the other end. Rod 331 is inserted into rod 332 and may have an exemplary length of about 10 inches. The larger rod may be custom sized at the time of fulfillment and dimple 337 formed when a customer selects a size for the rod. The dimple 336 is located the same distance from one of the rod ends, with one exemplary distance being approximately 12 inches in from the rod end. In the aforementioned examples, the spring length would be about 8 inches without compression. The exact location of the dimples can be modified based on the size of the spring, length and diameter of the rods and other factors affecting the strength required for the support rods.

FIGS. 8 and 9 illustrate a third embodiment of support rod 410. Rod 410 includes two dowels 412*a*, 412*b* positioned at respective ends of a center tube assembly 420. Tube assembly 420 is hollow, allowing a spring 430 and dowels 412 to be inserted therein as illustrated in FIG. 8 at each respective end to be inserted therein. Once assembled, as illustrated in FIG. 9, the support rod is inserted, and locks into place between, two u-tracks. As illustrated in FIG. 9, spring 430 is placed in the approximate center of the support rod assembly. Dowels 412 may be cut to various lengths to allow the support rod to fit into any size frame. End caps 350 attach to the ends of dowels 412. Each dowel 312, 320, and 412 may be made of metal, aluminum, wood, hollow plastic or solid plastic. Each tube assembly 420 may be made of plastic, aluminum or other metals.

Each of the support rods may be combined with any of the various end-cap and u-tracks to provide stability of the support rods in the u-tracks.

Figure 10A:
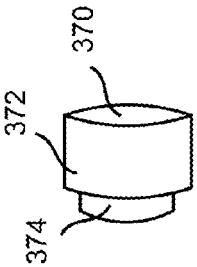
FIG. 10A is an illustration of a first end cap used in accordance with the present technology.
Figure 10B:
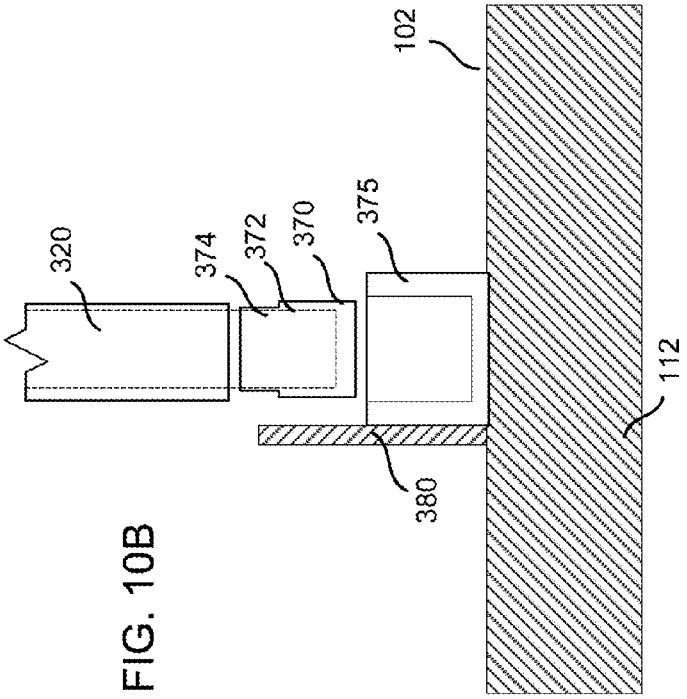
FIG. 10B is a cross section illustration of the first end cap on a support rod relative to a first u-track structure.

FIG. 10A illustrates a first embodiment of an end cap 350 and a cross-section of a first embodiment of a u-track 360. FIG. 10A is a perspective view of an end cap 370. FIG. 10B is an end view of the cap installed on a dowel positioned over a u-track. As illustrated in FIG. 10B, end cap 350 slides over the end of dowel 412 or 312 or 320. Cap 370 includes a first, end portion 372 and a connection portion 374. End cap 370 may be manufactured from plastic and inserted into a u-shaped track 375 having a simple U-shaped configuration. The cap is designed to sit entirely within the u-track so that an edge fabric or shade material can extend into the track. End caps and u-tracks may be manufactured from numerous types of hardened plastic materials.

FIG. 10B illustrates an optional decorative aspect to the technology. One or more thin boards 380 may be mounted adjacent to any of the u-tracks disclosed herein to cosmetically hide the edge of the fabric of the shade. In FIG. 10B, the board 380 is illustrated on the interior of the frame, but may alternatively used on the outward facing element of the frame. Two boards 380 on either side of the frame may be used. In other embodiments, the boards may be clear plastic and server to help maintain the window covering within the tracks on either side of the frame.

Figure 11A:
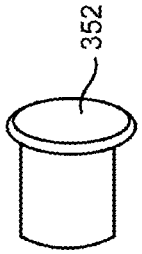
FIGS. 11A and 11B are illustrations of a second end cap and u-track system used in accordance with the present technology.
Figure 11B:
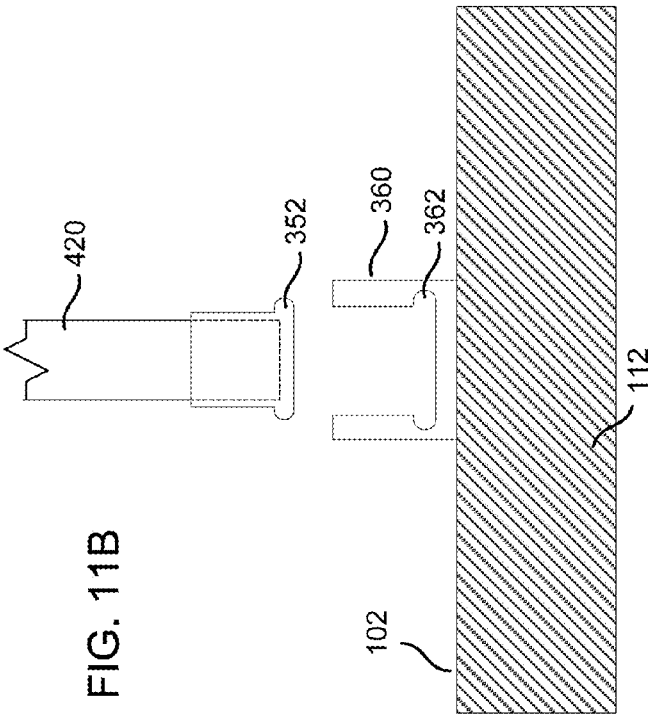

FIGS. 11A and 11B illustrate a second embodiment of an end cap 370. Cap 360 includes a circular lip 352 which engages a recess 362 in U-shaped track 360. Where the material of which end cap 370 and track 375 are manufactured, sufficient surface tension between the two materials resulting from the force of the spring in the support rod allows the shade assembly to maintain position within each of the tracks. Optimally, u-shaped track 360 is manufactured out of a slightly deformable plastic allowing the support rod to snap into place and the edge 352 engages the track 362 in structure 360.

Figure 13:
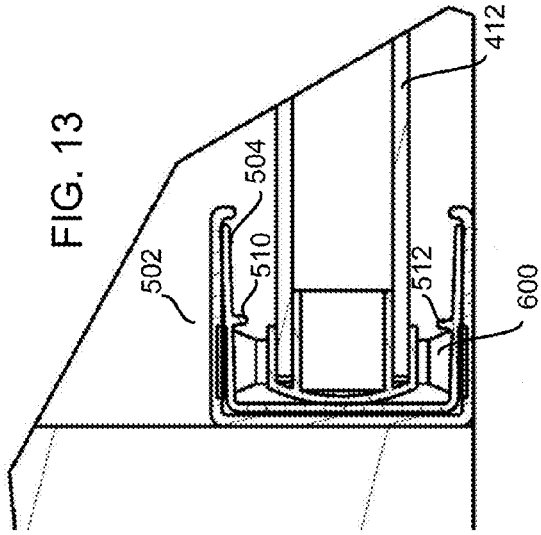
FIG. 13 is an assembled view of the third embodiment of the u-track system utilized with a third embodiment of an end cap.
Figure 12:
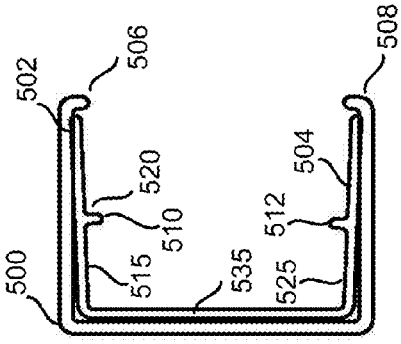
FIG. 12 is a cross-sectional view of a third embodiment of a u-track system utilized in accordance with the present technology.
Figure 15A:
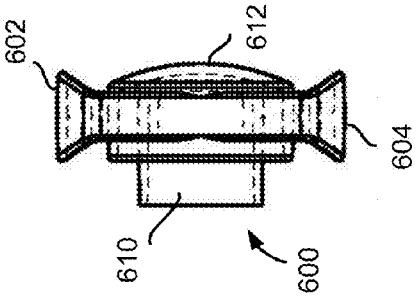

FIGS. 12-16 illustrate a third embodiment of a u-track and end cap configuration suitable for use with the present technology. In such embodiments, the track and end cap may again be plastic. FIG. 12 illustrates a two part u-track assembly comprising an outer shell 502 and an inner member 504. The outer member 502 is attached to the inner surface of the window. Next, the inner track 504, having a length matching that of the outer track 502, is snap-fit into the outer track along the length of the assembled installation. This allows any fasteners or other mechanisms which are utilized to attach the outer track 502 to the window frame to be covered by the inner track 504 so that the support rods will easily slide within the track. Outer member 502 includes curved ends 506, 508 which secure the inner member 504 within the outer member 502. Inner member 504 includes interior locking tracks 510, 512 which secure an end cap 600 therein as illustrated in FIG. 13. Tracks 510, 512 act as locking tracks to secure the end cap 600 within the u-track.

FIG. 13 illustrates a third embodiment of an end cap 600 attached to the end of a dowel 412 secured within the inner track 504. As illustrated therein, the end cap 600 is secured from movement out of the u-track by the locking tracks 510, 512. An extension region includes a recess 610 which allows the cap 600 to engage the support rod.

Figure 16:
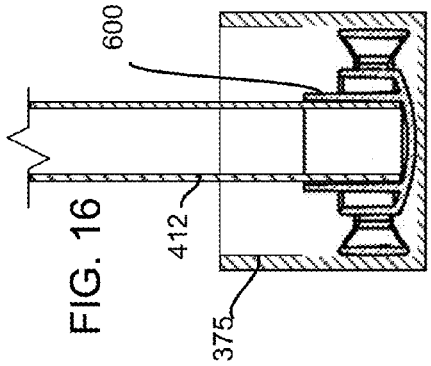
FIG. 16 is an assembled view of the third embodiment of the end cap with the first embodiment of the u-track.
Figure 15D:
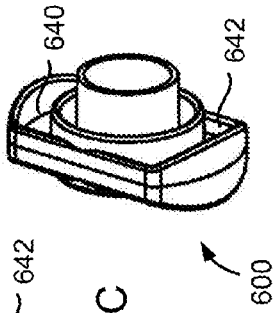
Figure 15C:
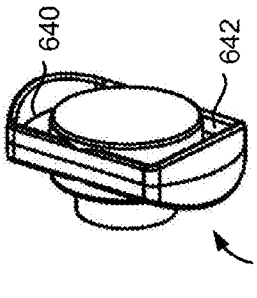
Figure 14:
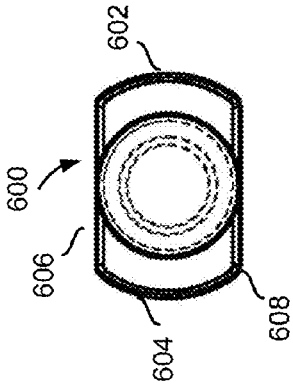
FIG. 14 is a plan view of the third embodiment of the end cap.
Figure 15B:
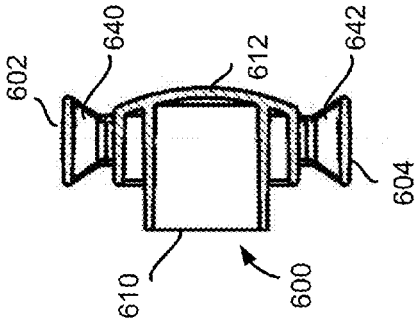
FIGS. 15A and 15B are top and cut-away views of the third embodiment of the end cap.

FIGS. 14-16 illustrate various features of the end cap 600. End cap 600 includes first curved edge 602 and second curved edge 604 which are designed to rest within the U-shaped track 500 and abut the edges 515 and 525 of inner track 504. A rounded face portion 612 engages the back portion 553 of the inner track 504. Optimally, the first edge 606 and second edge 608 allow for the rod to be inserted in to the U-shaped track. In one example, the support rod and cap 602 are rotated so that flat edge 606 and 608 are parallel with the length if the inner member, and then the cap is rotated so that edges 602 and 604 engage the walls of the track 502. Member 600 is optimally manufactured from an extruded plastic, allowing edges 602 and 604 to press-fit into engagement against the walls of the u-track. The curved edges 602 604, in combination with the recesses 640, 642, allow flexibility when the surfaces engage the inner track 504 by providing a spring force outward when engaging the inner track 504. This allows the member to slide easily up and down within the assembled u-tracks. The arcuate shape of edges 602 and 604 provide a constant pressure against walls 515 and 525, while the cap is held in place by locking track 510,512 of the inner track 504.

As noted herein, various types of end-caps can be combined with various types of u-tracks. As illustrated in FIG. 16, end cap 600 is combined with u-track 375.

Figure 17:
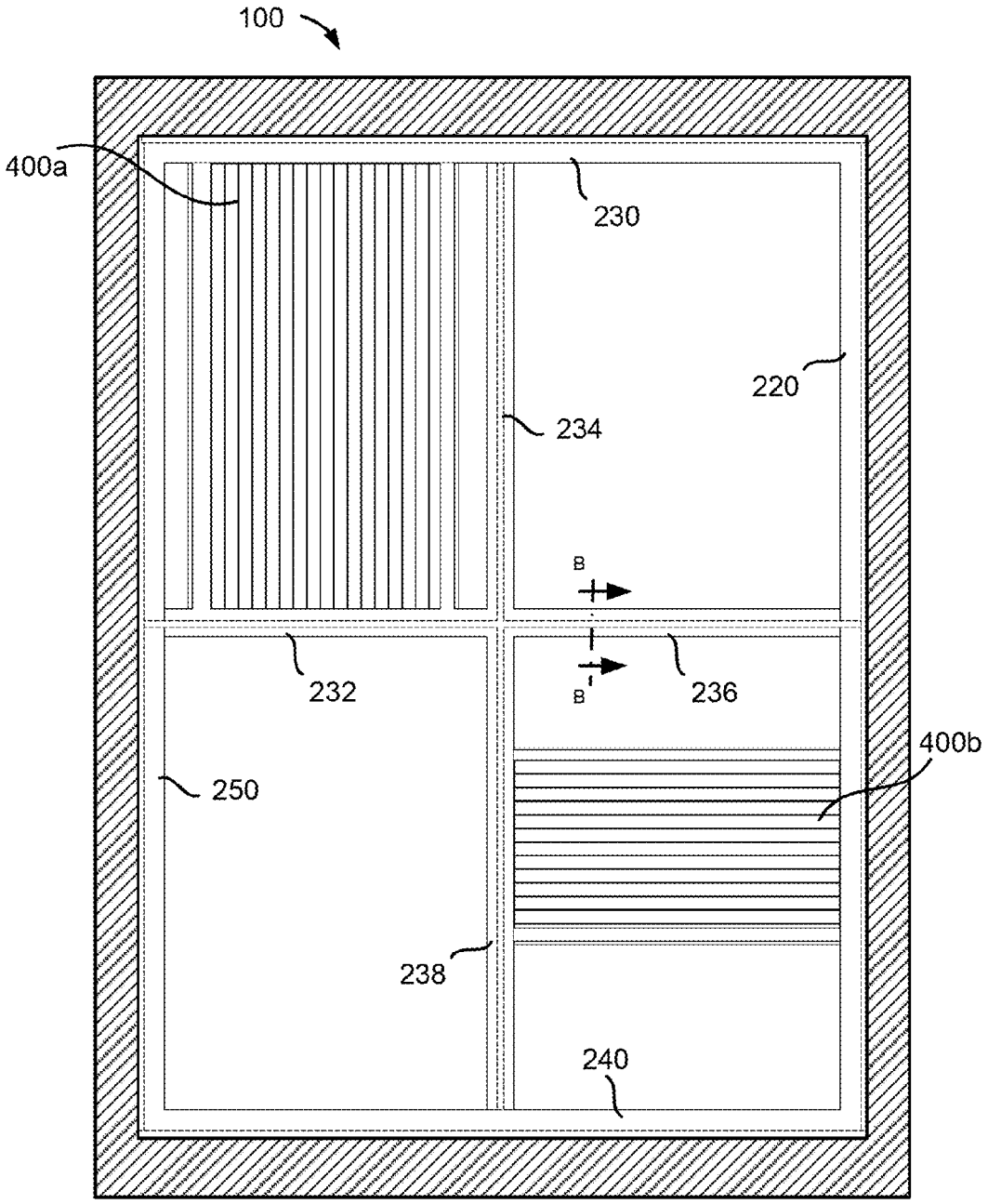
FIG. 17 is a plan view of a four-way assembly utilizing the technology presented herein.
Figure 18:
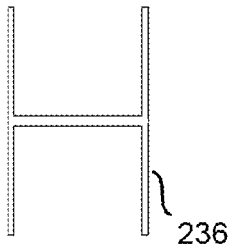
FIG. 18 is a cross-sectional view along line B-B in FIG. 17.

FIGS. 17 and 18 illustrate yet another embodiment of an assembled four-way shade assembly. In the embodiment of FIG. 17, a number of u-tracks 220, 230, 240, 250 are utilized adjacent to the edges of the frame, and a cross-track assembly 232, 234 is placed in the interior of the window. This allows two different shade assemblies 400*a* and 400*b* to be utilized in different regions of a particular window. Each cross-track assembly 232, 234 includes back to back u-track as illustrated in FIG. 18. Also as illustrated in FIG. 17, shade assemblies 400*a* and 400*b* may be positioned vertically, or horizontally.

This allows for greater flexibility in creating a shade design. The system can be used for windows of any dimensions. In a further embodiment, each u-track may include fabric elements positioned on the exterior portions of the track. This allows greater flexibility with respect to decorative elements in the use of the technology.

FIGS. 21A-21E illustrate yet another embodiment of an end cap suitable for use in any of the aforementioned embodiments of the present technology. End cap 700 is particularly advantageous in applications where narrow tracks are utilized. Cap 700 is formed of molded plastic to include 5 leaf spring elements 702, 704, 706, 708, 710 each having an arcuate section forming an interface with the interior of a track. The housing 750 allows the cap to couple to the support rod. An end nob 730 is formed by the spokes 702*a*, 704*a*, 706*a*, 708*a*, 710*a* making up the spoke structure. End cap 700 may be utilized with the various u-tracks disclosed herein, including for example tracks 362, 500 and 375, discussed above.

Figure 24:
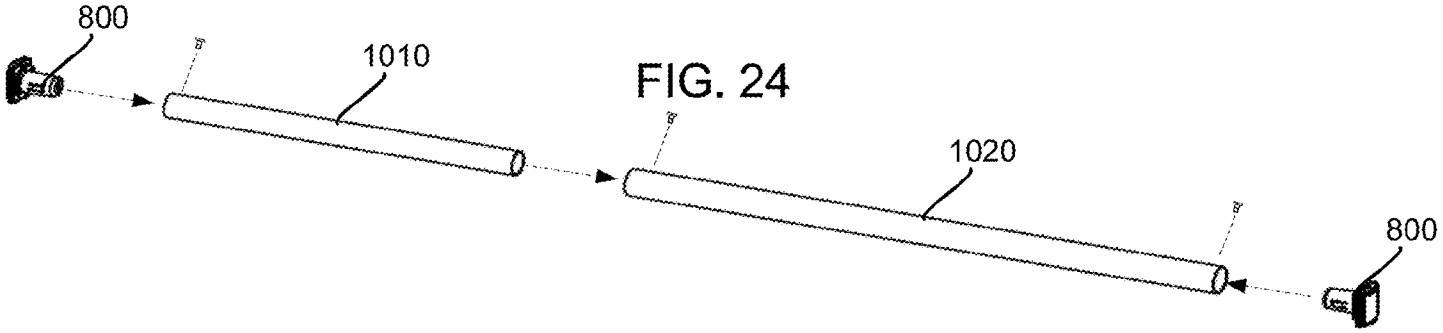
FIG. 24 is a perspective view of an end-cap and support rod assembly using the end cap shown in FIGS. 22 and 23A-23B.
Figure 22:
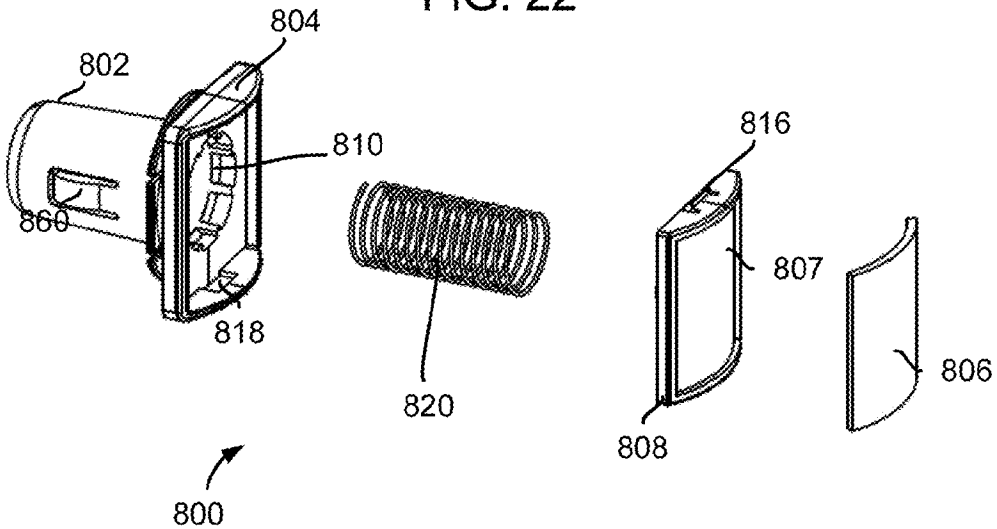
FIG. 22 is a perspective view of another embodiment of an end cap.

FIGS. 22 and 23 illustrate another embodiment of an end cap for use with the present technology. End cap 800 comprises a spring-loaded, friction fit end cap for use with the u-track assembly 900 illustrated in FIG. 23. End cap 800 includes a cylindrical housing body 802 mated to a pad housing 804 which receives a pressure pad 808. The housing body 802 and pad housing 804 may be may comprise a single plastic element. A rod-attachment flange 812 is provided to allow a fastener such as a thread or string to surround the body 802. The fastener can be used to attach elements such as rods to allow users to move the support rods with in the u-tracks without physically grasping the rods. A compression spring 820 is seated in a cavity 810 within housing 802. An pressure pad 808 engages spring 820 at a spring post 814 (FIG. 23) and is secured to pad housing 804 by two tabs 816 (only one of which is shown in FIG. 22) which engage recesses 818 (only one of which is shown in FIG. 22) in the pad housing 804. A friction pad 806 is attached to pressure 808 in a recess 807. Pressure is exerted against the pressure pad 808 by spring 820 and secures the end cap 800 in track assembly 900. Body 802 includes molded tabs 860, 862 which allow the housing to be secured in a support rod as illustrated in FIG. 24. In alternative embodiments, the tabs 860 and 862 are removed and fastener bores provided to allow the body to be secured to the rod using one or more fasteners.

Figure 32:
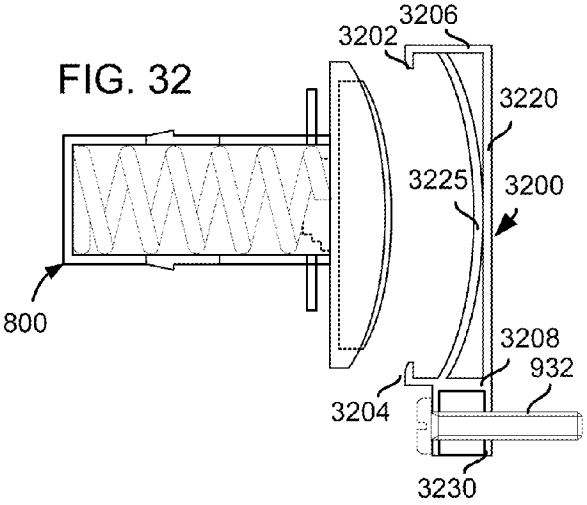
FIG. 32 is a top view of an end cap with an another alternative embodiment of a u-track.
Figure 33:
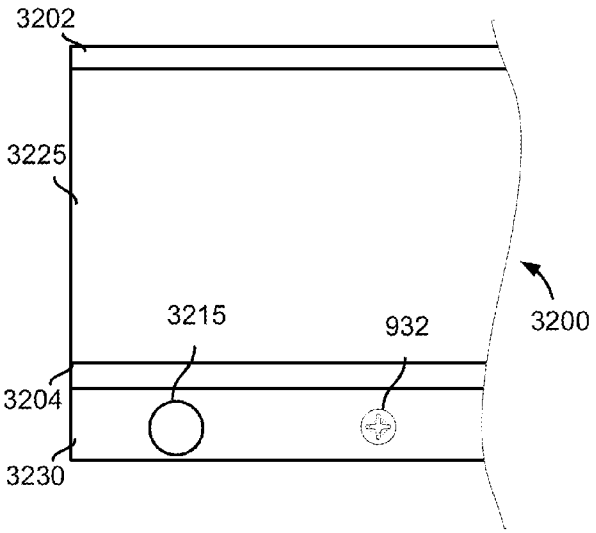
FIG. 33 is a top view of the u-track shown in FIG. 33.
Figure 23A:
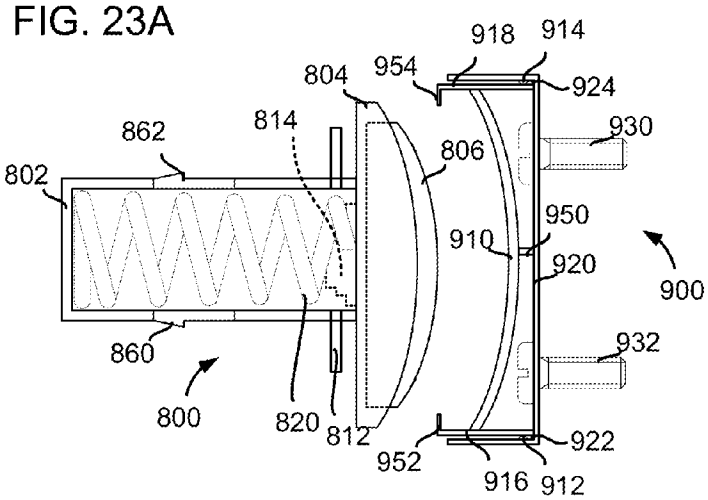
FIG. 23A is a top view of the embodiment of FIG. 22 shown with respect to another embodiment of u-track.
Figure 23B:
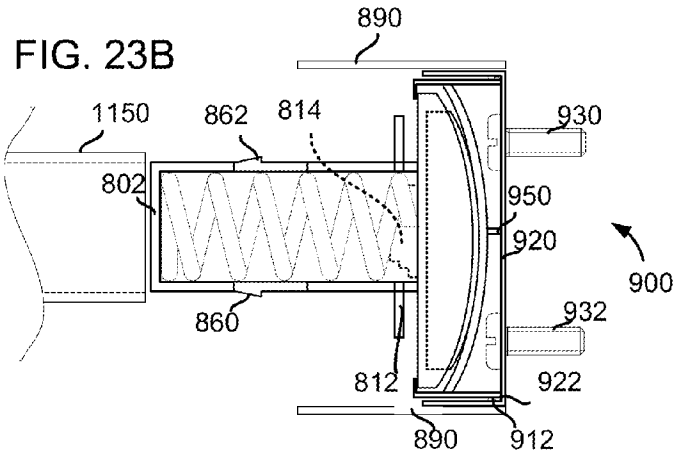
FIG. 23B is a top view of the embodiment of FIG. 22 engaged with a u-track.

End cap 800 is suitable for use with the u-tracks previously described as well as assembly 900 in FIGS. 23A and 23B and u-track 3200 in FIGS. 32 and 33.

Track assembly 900 (FIG. 23A, 23B) includes an inner guide track assembly 910 and outer u-track 920. The inner track is secured by a snap fit using edge beads 912/914 mating with inner track beads 922/924. This allows the outer u-track 920 to be inserted into a frame and secured by fasteners 930/932 while the mating surface 940 of the inner track 910 remains smooth to allow unrestricted movement of end cap 800 therein. The inner track includes a first sidewall 916 and second sidewall 918 including the edge beats 912,914. The curved mating surface 940 connects the first 916 and second 918 sidewalls, and includes a middle support wall 950 mating with the outer u-track 920.

The end cap 800 engages the track assembly 900 by snap fitting into the track such that the friction pad 806 engages the mating surface 940 of the guide track 910 and the back wall of body 804 engages lips 952, 954, as illustrated in FIG. 23B. Optionally, decorative slats 890 may be used in conjunction with u-track 900 to further shield the end cap 800 and edges of a shade supported by rod 1150 from view.

FIG. 24 illustrates assembly of the end caps 800 and support rods. Any of the support rods previously described may be utilized. Alternatively, as illustrated in FIG. 24, fasteners may be used to secure a first, inner rod element 1010 to a second, outer rod element 1020. Fasteners may likewise be used to secure each of the end caps 800 to the respective inner rod element 1010 and outer rod element 1020.

Figure 25A:
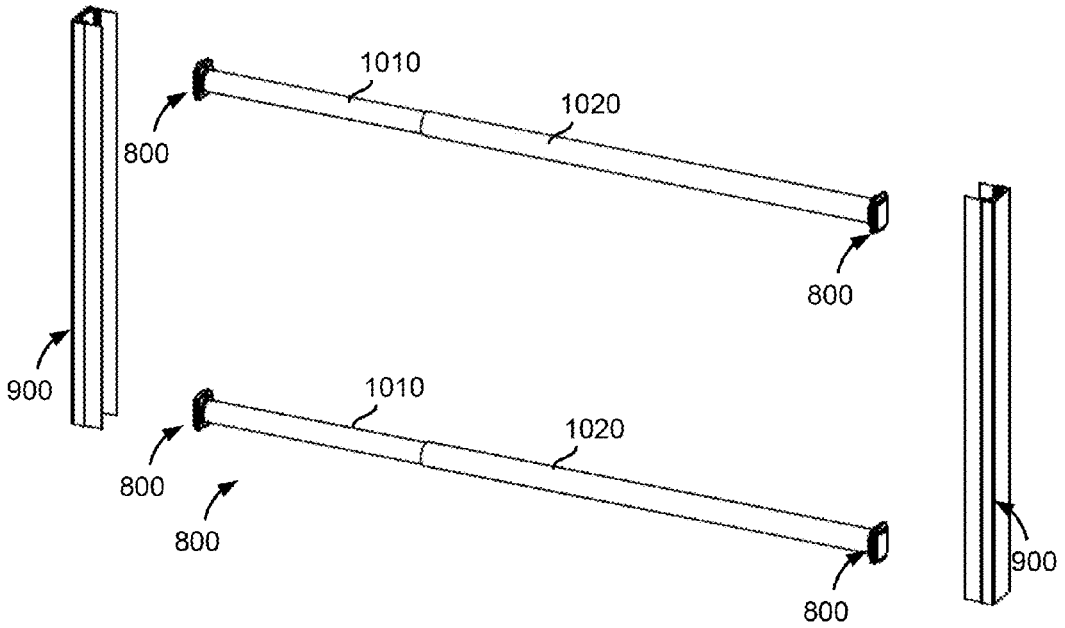
FIG. 25A is a perspective view of a partially exploded U-track and support rod assembly using the end cap and u-track of FIGS. 22 and 23A-23B.
Figure 25B:
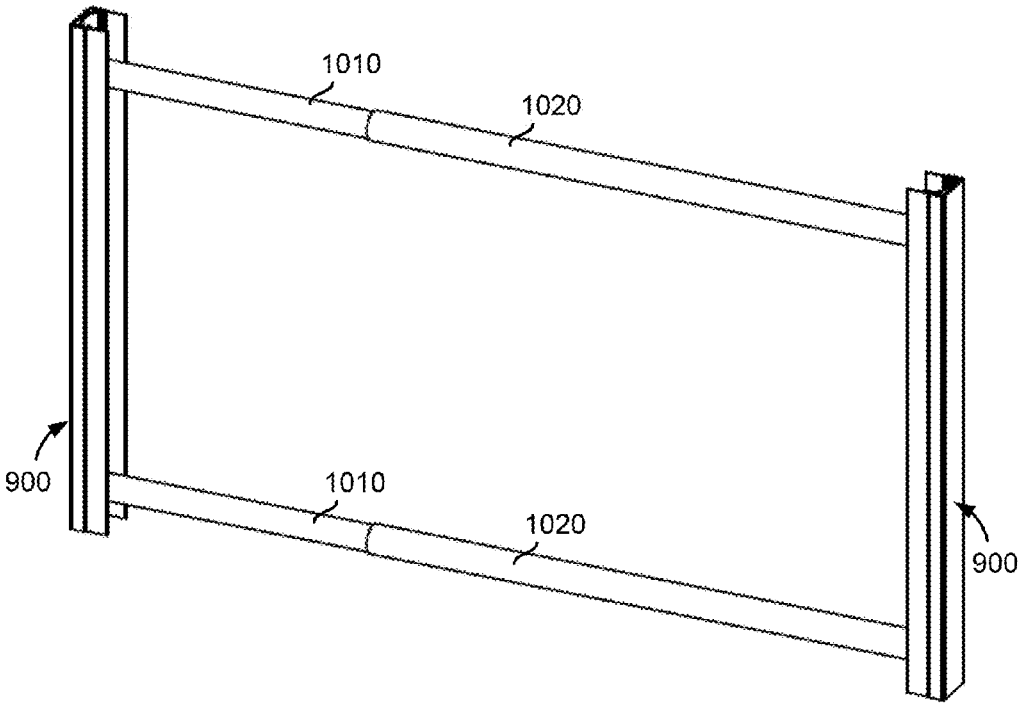
FIG. 25B is a perspective view of an assembled U-track and support rod assembly using the end cap and u-track of FIGS. 22 and 23A-23B.

During installation, the outer u-tracks 920 may be installed into the frame followed by snap-in of the inner assembly 910 into the outer u-tracks. End caps 800 may be provided in the inner assemblies 910 prior to assembly of the inner assembly 910 with the outer u-track by sliding the cap into one end of the inner assembly, then snap fitting the inner assembly 910 into the outer u-track 920. The inner rod element 1010 may then be inserted into the outer rod element and one end secured to an end cap 800. The remaining unsecured rod end is secured to the second end cap 800 and the rods fastened to each other. As will be understood, numerous variations on such assembly may be provided. Assembled versions of the rods are illustrated in FIGS. 25A and 25B.

As noted above, numerous different types of window coverings may be used with the present technology. When using a fabric shade such as a so called "Roman" shade, additional securing elements may be needed to maintain a proper appearance of the covering. In certain uses, the shade may have a tendency to collapse outside of the frame and to maintain appearance of the shade, measures may be teaken such as those in FIGS. 26-35.

FIGS. 26A-C and 27 illustrate a shade holder bracket 1100 which may be inserted into track assembly 900 (or adapted for use with any of the above mentioned u-tracks) to secure portions of the window covering between the end-rods. Shade holder 1100 includes a first and second wings 1102, 1104 separated by a back support 1120 which extends from wings 1102, 1104 to reach the inner assembly 910 when the holder 1100 is slid into the u-track assembly 900 as illustrated in FIG. 27. Each wing 1102, 1104 has an outer edge 1106, 1008, respectively, to engage the sides of inner assembly 910. A face 1110 is perpendicular to wings 1102, 1104 and extends out generally perpendicular to the inner assembly 910 and u-track assembly 900. As illustrated in FIG. 27, multiple shade holders 1100 are provided in u-track 900 such that each engages a portion of a window covering 1150. Each face 1110 of each shade holder 1100 may be secured to the window covering using any of a number of suitable techniques, including removable fasteners such as fabric hook-and-loop fasteners, with the one portion of the fastener attached to the covering and another attached to the face 1110. Any number of shade holders may be utilized.

In an alternative embodiment, shade holders are attached to alternating sides of the shade or covering. This is particularly useful in so-called Roman shade styling.

Figure 28:
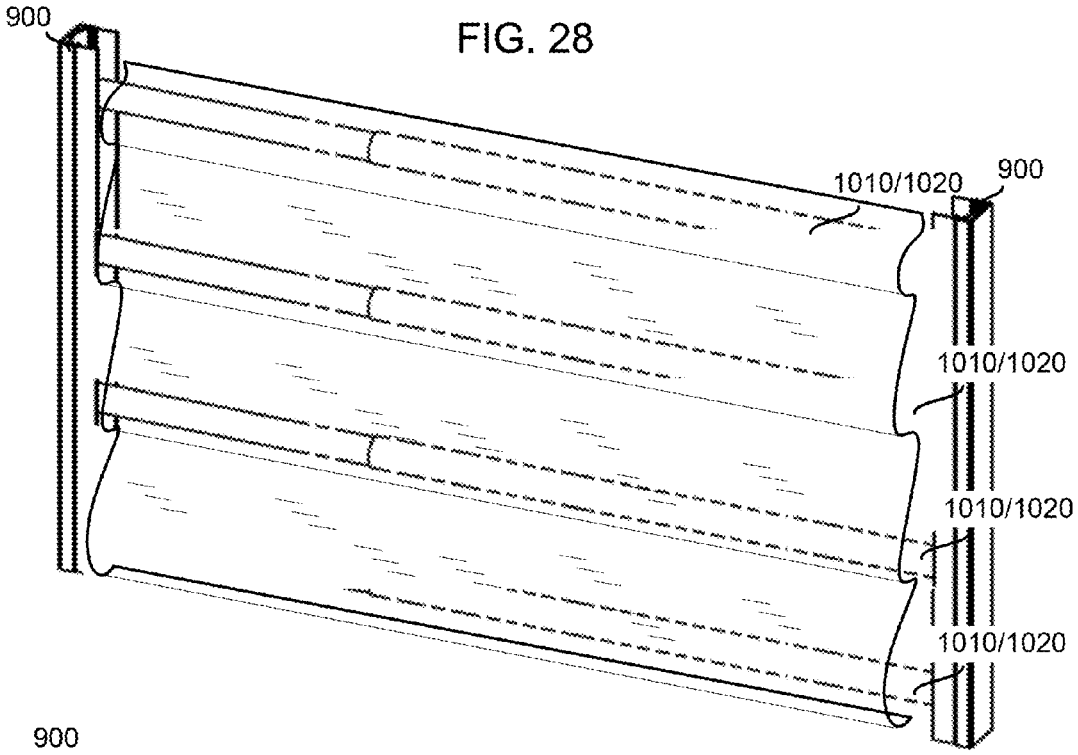
FIGS. 28 and 29 are perspective views of alternatives for constructing a folded or "Roman" shade assembly in accordance with the present technology.
Figure 29:
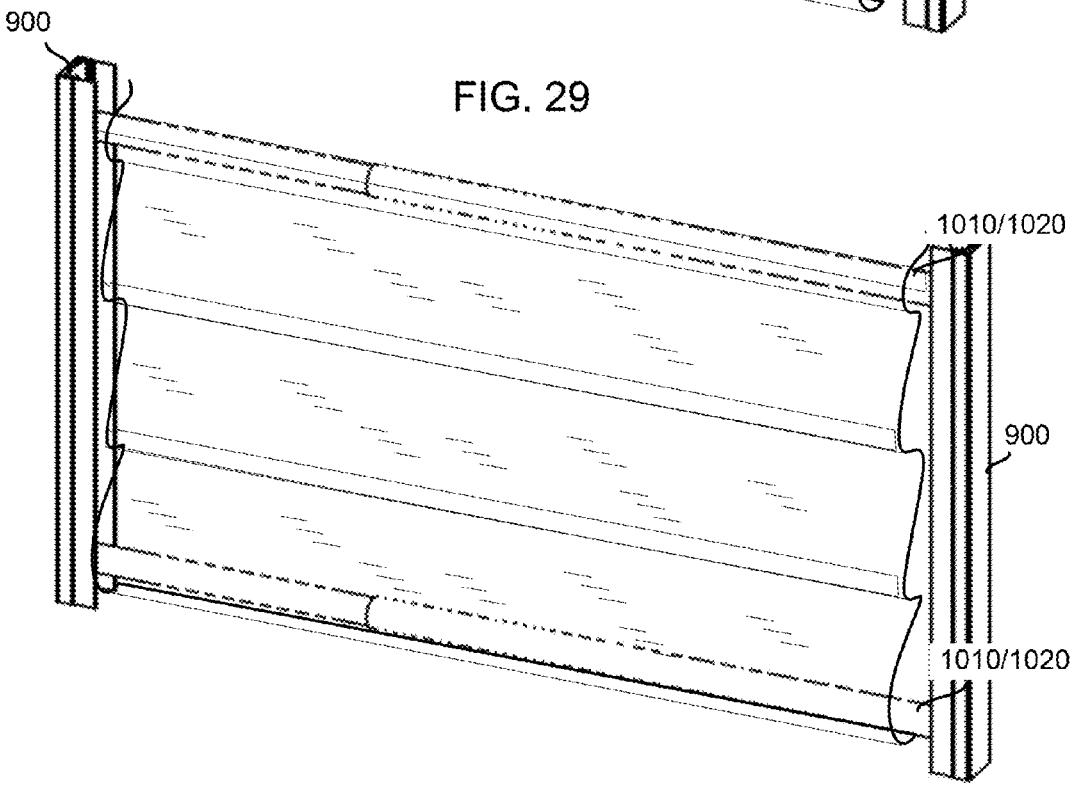

FIGS. 28 and 29 illustrate two alternative embodiments of the present technology for implementing a so-called "Roman" shade—a style of window treatment consisting of a fabric shade with slats which are inserted horizontally at intervals down the length of the shade. A roman shade can be raised or lowered and the fabric gathers or folds (like an accordion) as you raise the shade depending on the style: flat fold (gathers) or hobbled fold (folds), also known as teardrop style.

In FIG. 28, multiple support rods (310, 1010/1020) such as those described above are utilized at each fold in the fabric. This embodiment allows control of the placement of each fold of the shade. IN another alternative, shown in FIG. 29, standard slats 1210,1212 are utilized, with (shown) or without (not shown) shade holders 1100. FIGS. 28 and 29 illustrate the adaptability and variability of the present technology to different window treatment designs.

Figure 30A:
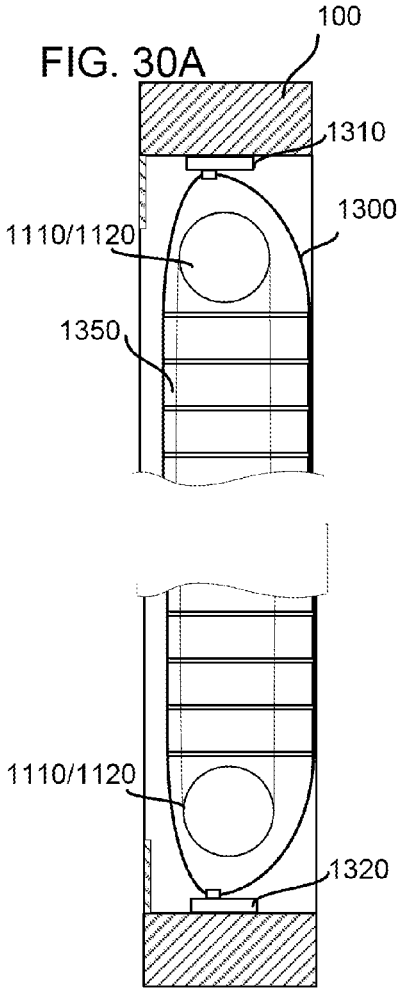
FIGS. 30A and 30B illustrate a first embodiment of retaining band assembly for use in accordance with the present technology.
Figure 30B:
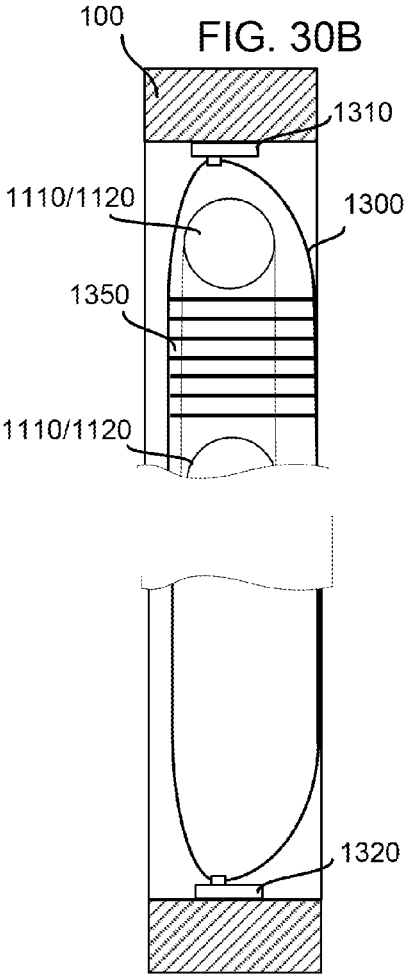
Figure 30C:
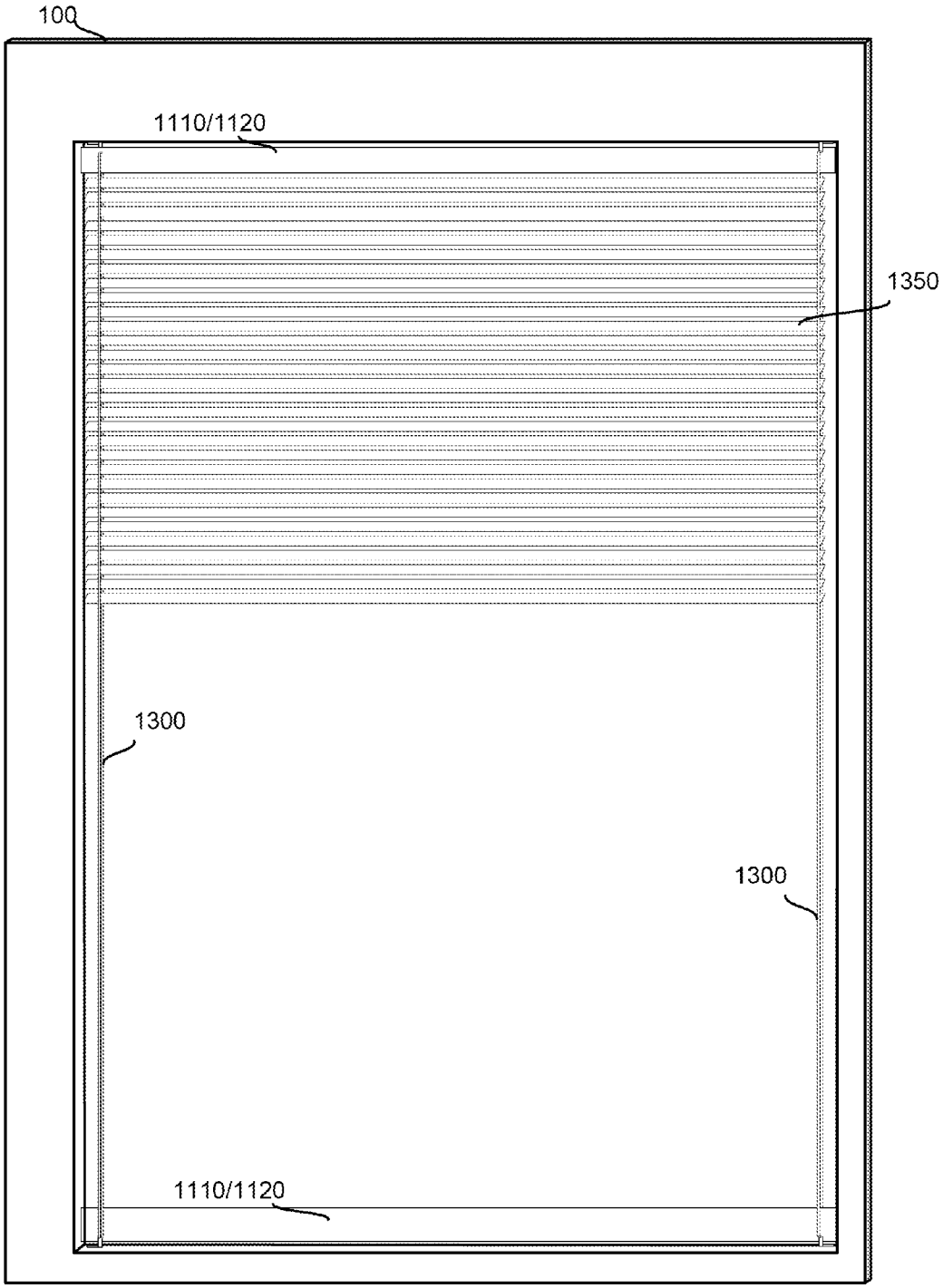
FIG. 30C illustrates a mini-blind used in accordance with the retaining band shown in FIGS. 30A and 30B.

FIG. 30A-30C illustrate another unique feature of the present technology. Some window treatments such as honeycomb shades, Roman shades and mini-blinds require additional lateral support to ensure they extend and collapse in a visually appealing manner. For such applications, a retaining structure coupled to fixed points at the top and bottom of the frame may be used. In one embodiment, a retaining structure comprises a retaining band 1300 may be utilized in conjunction with support brackets 1310 and 1320 provided at the top and bottom portions of the window treatment in order to maintain the tracking of the shade within the confines of the u-track elements. FIGS. 30A-30C illustrate a mini-blind 1350 in an extended position (FIG. 30A) and a retracted position (FIG. 30B) where an elastic band 1300 is provided around exterior edges of the blinds. The band is secured to an upper 1310 and lower 1320 support bracket which is secured to the top and bottom of the frame. Cover panels 1360 may be utilized to hide the connection brackets 1310 and 1320. FIG. 30C illustrates an embodiment whereby two bands 1300 are used in accordance with the present technology. Optionally, the bands may be comprised of a clear stretchable plastic to minimize any effect on the appearance of the window treatment.

Figure 31A:
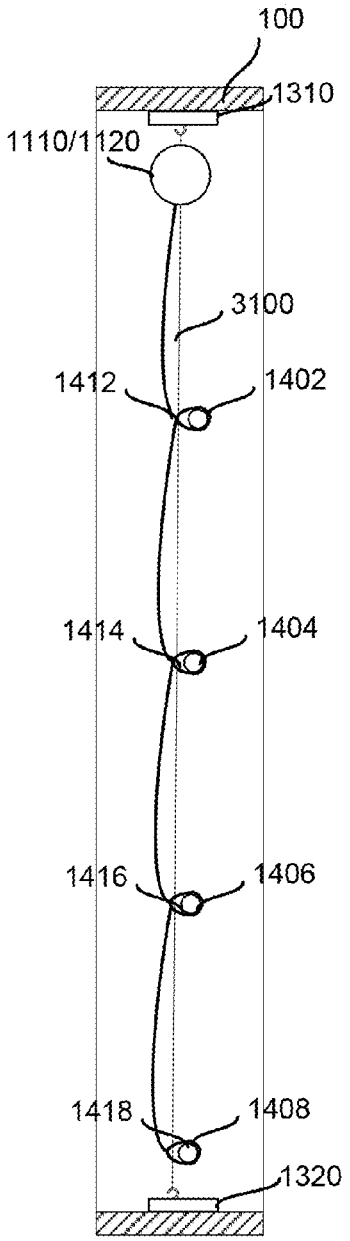
FIGS. 31A and 31B illustrate a retaining wire assembly for use in accordance with certain embodiments of the window covering in accordance with the present technology.
Figure 31B:
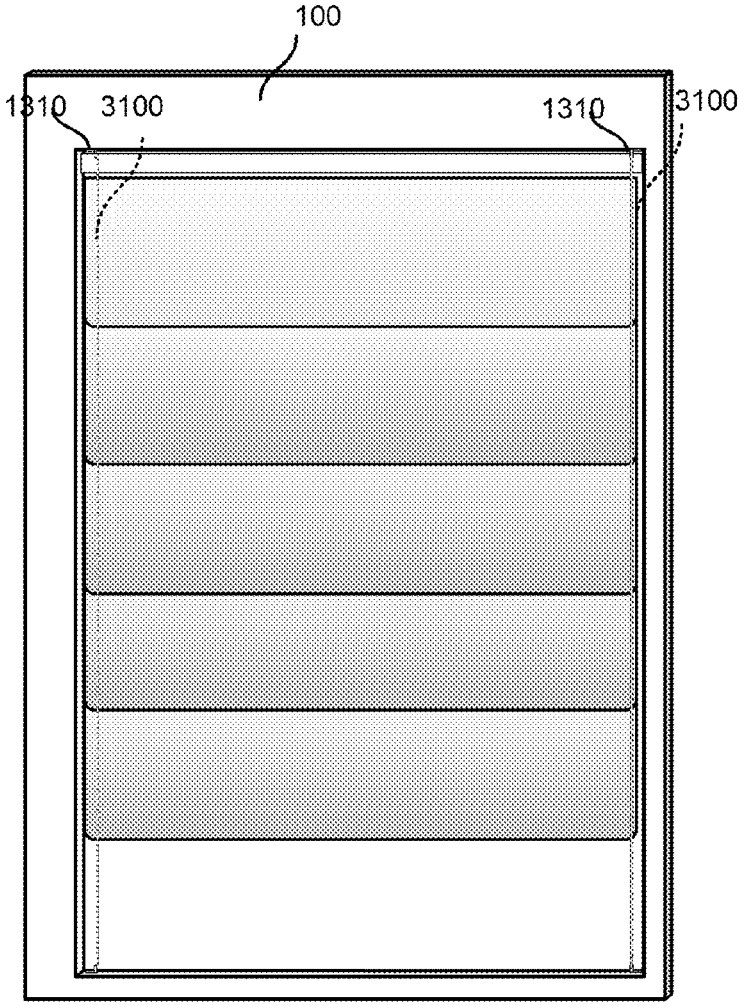

FIGS. 31A and 31B illustrate another retaining structure alternative for supporting movement of window treatments such as honeycomb shades, Roman shades and mini-blinds. The concepts illustrated in FIGS. 31A and 31B may be used with various types of window coverings, but for illustration purposes a Roman shade is shown. A Roman shade covering 1400 includes a plurality of support rods 1402, 1404, 1406, 1408 which are generally secured at a seam 1412, 1414, 1416, 1418. In one embodiment, a support wire or thread 3100 is provided through various portions of fabric or the shade material adjacent to the seams. Wire 3100 may comprise string, plastic wire, nylon® wire, metal wire, or any suitable straight, strong and relatively tension free material. Depending on the covering, the wire 3100 may be stitched through roughly equidistant points along the length of a covering. As illustrated in FIGS. 31A and 31B, two wires 3100 and 3101 are used on opposing sides of the covering adjacent to the edges of the frame and the u-tracks. Any multiple of wires may be used. In other types of coverings, where stitching directly through the material of the fabric is of suitable, washers or eyelets may be provided in the covering material to allow the wire to pass through the covering at designated points. In one embodiment, the wire is connected to the support brackets 1310 and 1320.

During installation, window coverings may be provided with the wire pre-installed in the covering material, with each end of the wire available for coupling to the support brackets 1310 and 1320. Alternatively, a user may manually stitch the wire through the covering material when installing the window covering and subsequently attach the wire to the support brackets.

FIGS. 32 and 33 illustrate another embodiment of a u-track suitable for use with the present technology. U-track 3200 includes a base 3220, inner guide track 3225, outer wall 3206, inner wall 3208, retaining lips 3202, 3204 and mounting structure 3230. Mounting structure 3230 extends to one side of the track when positioned against a frame element to allow fasteners 932 to be mounted therein. U-track 3200 may be fabricated from a single piece of plastic. Fasteners 932 may be positioned along various portions of u-track 3200.

In addition, u-track 3200 may include a mounting bore 3215 allowing a fastening dowel 3400 (illustrated in FIGS. 34 and 35) to be used to secure the retaining band or retaining wires, as discussed below.

Figure 34:
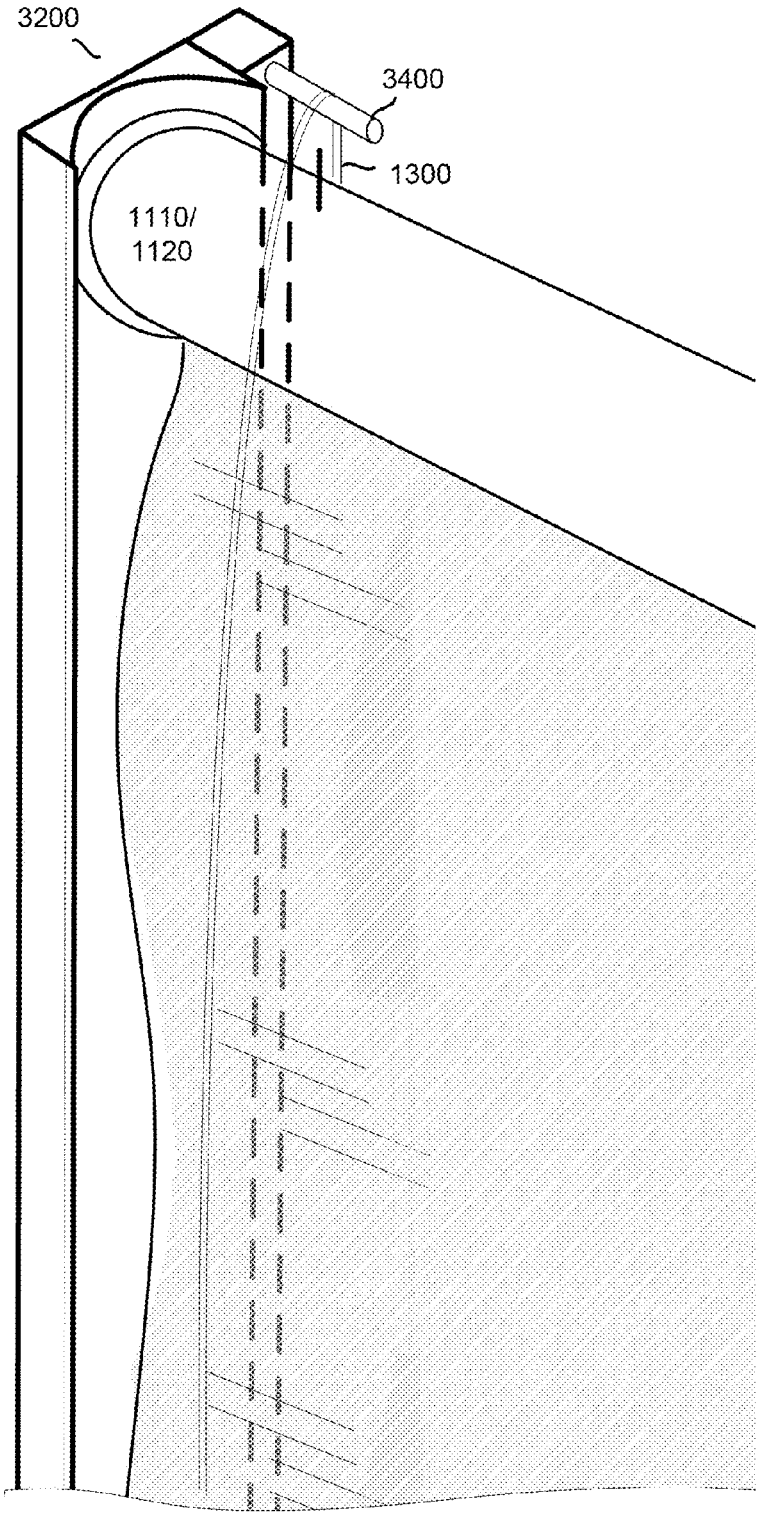
FIG. 34 is a perspective view of the retaining band assembly used with a fastening system in conjunction with the u-track of FIGS. 32 and 33.
Figure 35:
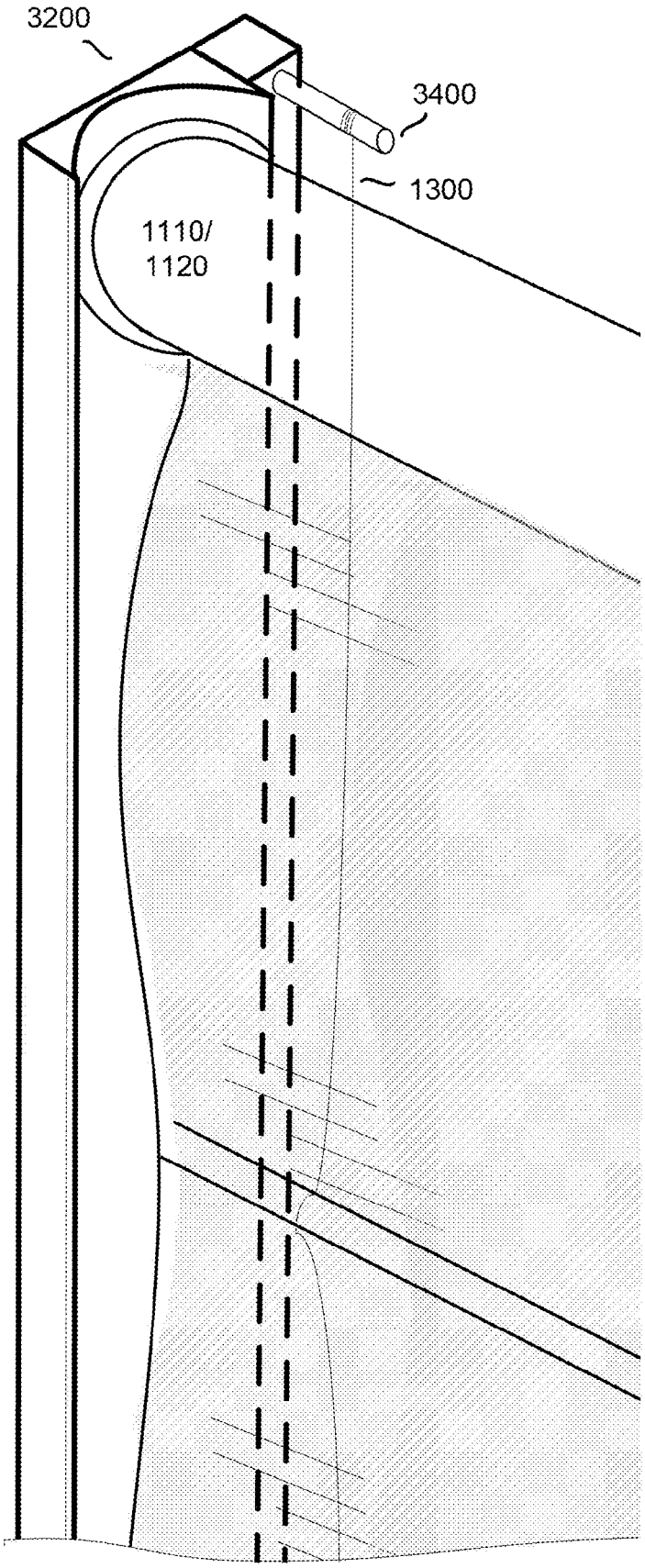
FIG. 35 is a perspective view of a retaining wire assembly used with the fastening system in conjunction with the u-track of FIGS. 32 and 33.

As illustrated in FIGS. 34 and 35, one or more fastening dowels 3400 or other retaining elements may be mounted in a portion of the u-track to secure the upper and lower portions of a retaining band (FIG. 34) or retaining wire (FIG. 35). Conveniently, the fastening dowel 3400 is positioned toward one side of the window covering (in one embodiment, the side of the covering closest to the window) and behind the mounting rods. Although as dowel which is inserted into mounting bore 3215 is illustrated, any form of hook or retaining structure may be incorporated into the u-track 3200. Dowel 3400 may be slightly offset with respect to the position of the retaining wire through the covering.

Figure 36A:
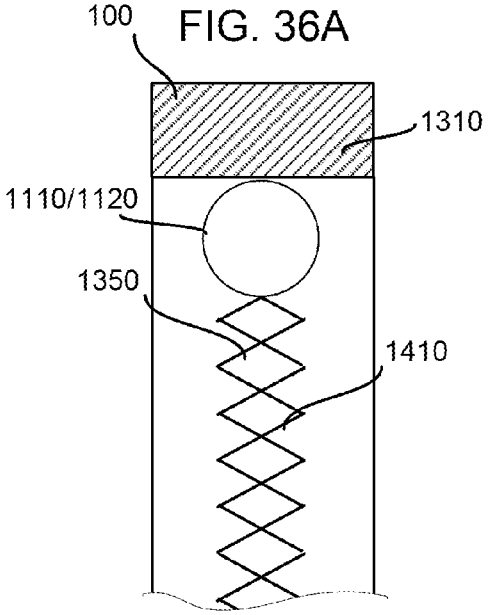
FIGS. 36A and 36B illustrate a rod collection element for use in accordance with the present technology.
Figure 36B:
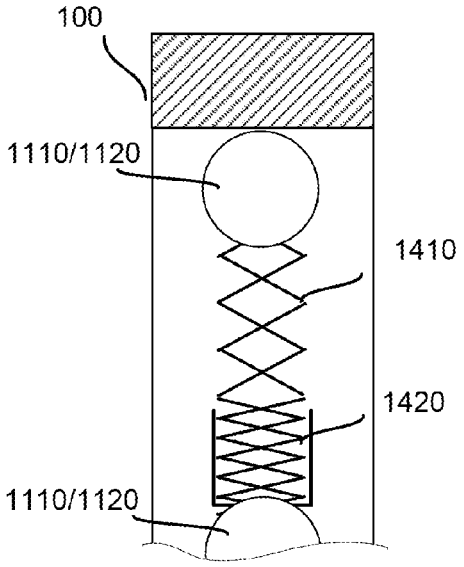
Figure 36B:
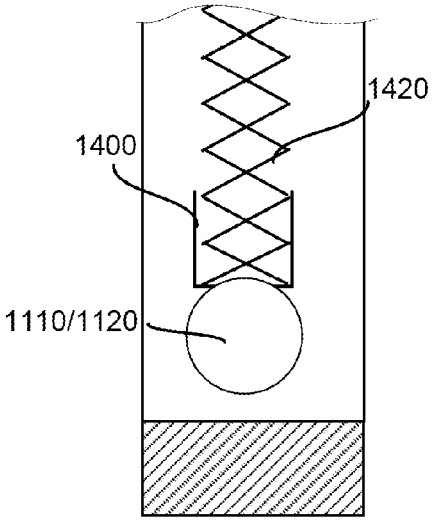
Figure 36B:
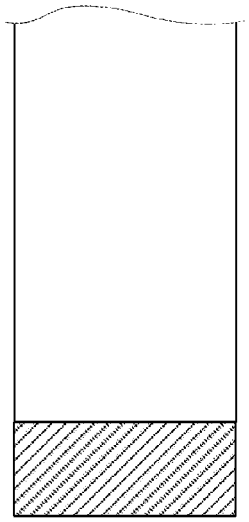

FIGS. 36A and 36B illustrate a rod mounted, fabric collection element 1400 which can be used with honeycomb shades and other coverings to collect portions of coverings that do not collapse evenly. As illustrated in FIG. 31A, a fully extended shade has a generally evenly distributed set of folds. However, when collapsing the covering, such as, for example, by raising the lower support rod in FIG. 31B, the lower elements of the shade 1420 collapse before the upper elements 1410. This is generally due to the weight of the covering. To prevent unsightly rollover of the collapsed portions, a collector 1400 may be provided on the base support rod into which the covering element is folded during retraction.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A window treatment system, comprising:

a first and a second u-track, each having a first end and a second end, the u-shaped cross-section including a first wall and a second wall joined by an arcuate base, the walls and base extending between the first end and the second end, positioned on opposite sides of a window frame;

a first support rod having a first end frictionally fit in the first u-track and a second end frictionally fit in the second u-track;

a second support rod having a first end frictionally fit in the first u-track and a second end frictionally fit in the second u-track;

a window covering coupled to the first and the second support rods, the window covering suspended from and having a weight supported by at least the first or second support rod;

wherein each end of each support rod includes a removable end cap having a housing body, a pressure pad and a pressure pad housing, the housing body containing a spring having a first end engaging an end of the housing body and a second end engaging the pressure pad and adapted to apply pressure to the pressure pad, the pressure pad receiving an arcuate friction pad, the arcuate friction pad having an arcuate surface engaging the arcuate base, and each end of each support rod being independently movable in each respective u-track, wherein a locking ridge is provided on an end of each of the first and second walls of each u-shaped cross-section, the locking ridge engaging a surface of the pressure pad housing.

2. The system of claim 1 wherein the window frame includes a top and a bottom, and a first and second sides, and the first support rod and the second support rod are positioned horizontally between the first and second sides of the window frame.

3. The system of claim 1 wherein each end cap is coupled to an end of each support rod by one of a friction fit, spring elements or fasteners.

4. The system of claim 1 wherein each support rod comprises a first dowel, a second dowel, and a spring positioned between the first dowel and the second dowel.

5. The system of claim 1 wherein the window covering includes a first mounting loop and a second mounting loop, each loop having a diameter sufficient to surround a support rod.

6. The system of claim 5 wherein the first support rod is mounted in the first mounting loop and the second support rod is mounted in the second mounting loop.

7. The system of claim 1 further including a retaining structure fixed at a respective top and bottom positions relative to the window frame and engaging the window covering.

8. A method of installing the window treatment system as recited in claim 1, comprising:

(a) attaching the first u-track to a first side of the window frame;

(b) attaching second u-track to the second, opposing side of the window frame;

(c) installing the window covering on the first support rod and the second support rod;

(d) inserting the first end of the first support rod into the first u-track;

(e) inserting the second end of the first support rod in the second u-track;

(f) inserting the first end of the second support rod into the first u-track;

(g) inserting the second end of the second support rod into the second u-track.

9. The method of claim 8 wherein the method further includes the steps, prior to said steps of attaching, of:

cutting at least the first end of the first and second support rods to a length sufficient to place each support rod in a frictional engagement with each u-track.

10. The method of claim 8 wherein installing the window covering on the first support rod and the second support rod includes inserting the first support rod through a first shade mounting loop and inserting the second support rod through a second shade mounting loop.

11. The method of claim 10 further including the step of inserting a first side of the window covering into the first u-track and inserting a second side of the window covering into the second u-track.

12. The method of claim 8 further including the step of fixing a first end of a retaining structure at a top position of the window frame and fixing a second end of the retaining structure at a bottom position relative to the window frame.

13. A window treatment system, comprising:

a first u-track, having a u-shaped cross-section, and a second u-track, having a u-shaped cross-section, positioned on opposite sides of a window frame, each u-shaped cross-section comprising a first wall, a second wall and an arcuate base;

a first support rod having a first end positioned in the first u-track and a second end positioned in the second u-track;

a second support rod having a first end positioned in the first u-track and a second end positioned in the second u-track;

wherein each end of each rod includes an end cap having a housing body, a pressure pad and a pressure pad housing, the housing body containing a spring having a first end engaging an end of the housing body and a second end engaging the pressure pad and adapted to apply pressure to the pressure pad, the pressure pad receiving an arcuate skid plate having an arc matching the arcuate base of each u-shaped cross section, and each end of each support rod being independently slidable in each respective u-track; and wherein a shade has a first end having a mounting loop surrounding the first support rod and a second end having a mounting loop surrounding the second support rod, the shade having a first side at least partially contained within said the first u-track and a second side at least partially contained within the second u-track, wherein a locking ridge is provided on an end of each of the first and second walls of each u-shaped cross-section, the pressure pad housing has a first side receiving the pressure pad and a second side opposing the pressure pad, the locking ridge engaging the second side of the pressure pad housing.

14. The system of claim 12 wherein each end cap is attached to each end of each support rod by one of a friction fit, spring elements or fasteners.

15. The system of claim 12 further including a retaining structure fixed at a respective top and bottom positions relative to the window frame and engaging the shade.

* * * * *